United States Patent [19]

Wheeler et al.

[11] Patent Number: 4,923,546

[45] **Date of Patent: * May 8, 1990**

[54] METHOD AND APPARATUS FOR FORMING A BUTT SPLICE

[75] Inventors: Roger R. Wheeler, Roscoe; John R. Martin, Rockford, both of Ill.

[73] Assignee: Martin Automatic Inc., Rockford, Ill.

[ * ] Notice: The portion of the term of this patent subsequent to Jan. 31, 2006 has been disclaimed.

[21] Appl. No.: 302,569

[22] Filed: Jan. 26, 1989

Related U.S. Application Data

[63] Continuation-in-part of Ser. No. 153,578, Jan. 29, 1988, Pat. No. 4,801,342, which is a continuation of Ser. No. 907,117, Sep. 12, 1986, abandoned.

[51] Int. Cl.[5] ..... B31F 5/06; B65H 69/06

[52] U.S. Cl. ..... 156/159; 156/267; 156/304.3; 156/504; 156/505; 156/510; 242/56 R; 242/58.5

[58] Field of Search ..... 156/159, 258, 267, 304.3, 156/304.5, 504, 505, 510, 518, 523, 527; 242/56 R, 58.1, 58.3, 58.4, 58.5

[56] References Cited

U.S. PATENT DOCUMENTS

| | | | |
|---|---|---|---|
| 3,554,842 | 1/1971 | Byrt | 156/505 |
| 3,649,416 | 3/1972 | Chapman | 156/523 |
| 3,773,598 | 11/1973 | Taeffner et al. | 156/159 |
| 3,819,454 | 6/1974 | Mason | 156/505 |
| 3,886,031 | 5/1975 | Taitel | 156/505 |
| 3,939,032 | 2/1976 | Taitel et al. | 156/159 |
| 3,957,567 | 5/1976 | Purcell et al. | 156/523 |
| 4,010,911 | 3/1977 | Heitmann | 156/505 |
| 4,157,934 | 6/1969 | Ryan et al. | 156/505 |
| 4,190,475 | 2/1980 | Marschke | 156/504 |
| 4,190,483 | 2/1980 | Ryan et al. | 156/505 |
| 4,260,444 | 4/1981 | Fowler | 156/271 |
| 4,284,463 | 8/1981 | Wright | 156/505 |
| 4,310,378 | 1/1982 | Bosco | 156/518 |
| 4,417,940 | 11/1983 | Koster | 156/505 |
| 4,526,638 | 7/1985 | Clements | 156/159 |
| 4,543,152 | 9/1985 | Nozaka | 156/505 |
| 4,629,531 | 12/1986 | Katroka | 156/504 |
| 4,645,558 | 2/1987 | Sato | 156/504 |
| 4,652,329 | 3/1987 | Focke | 156/504 |
| 4,769,098 | 9/1988 | Cederholm et al. | 156/505 |
| 4,801,342 | 1/1989 | Wheeler et al. | 156/505 |

*Primary Examiner*—Michael Wityshyn

*Attorney, Agent, or Firm*—McAndrews, Held & Malloy, Ltd.

[57] ABSTRACT

A method and apparatus is disclosed for forming a zero-speed, butt splice to join together a web from a new roll of material to a web which is from an expiring roll of material and which should be run, at a relatively high speed, through a web processing operation, such as a disposable diaper manufacturing line, under relatively constant, relatively low tension along a predetermined path of travel that includes a running web festoon means having floating dancer rollers and the running web processing operation. To form the butt splice, the leading end of the new web is trimmed by moving one knife wheel assembly along the cutting edge of an anvil. A piece of tape is applied to the leading end so that a portion of the tape projects downstream from that end. The expiring web is held against the anvil and trimmed along the same cutting edge of the anvil. The trailing end of the expiring roll is also simultaneously adhered to the downstream portion of the tape. Only the portion of the expiring roll adjacent to the anvil is momentarily stopped while the expiring web is trimmed and adhered to the leading end of the new roll. The stoppage is sufficiently short so that downstream portions of the expiring web can, in the interim, be withdrawn from the festoon means so that web continues to run, at its relatively high speed and under it relatively constant, relatively low tension, through the web processing operation.

5 Claims, 9 Drawing Sheets

METHOD AND APPARATUS FOR FORMING A BUTT SPLICE

This application is a continuation in part of pending U.S. application Ser. No. 153,578, filed Jan. 29, 1988, now U.S. Pat. No. 4,801,342. Application Ser. No. 153,578 is, in turn, a continuation of application Ser. No. 907,117 filed Sept. 12, 1986, now abandoned.

BACKGROUND OF THE INVENTION

The present invention relates to a method and apparatus for joining together a web from a new roll of material to a web from an expiring roll that is being fed to a continuous web processing operation. More particularly, this invention relates to a method and apparatus for joining, by a zero-speed butt splice, the leading end from a new roll of web material to the trailing end from an expiring roll of web material where the web material is continuously processed, at a relatively high speed, through a web processing operation and where the web material, such as the web materials used in making disposable diapers, must be maintained at a relatively constant, relatively low tension because of the nature of the web material.

Disposable diapers are made by combining various webs of materials, one on top of another, in a relatively high speed, continuous manufacturing process. These webs include polyethylene, and various absorbent and hydrophilic inner liners that have different modula of elasticity and that readily inelastically deform under even low tensions. Disposable diaper manufacturing processes are additionally complicated, from a web handling standpoint, by the inclusion of elastic bands that serve, in the completed diaper, to prevent leakage about the infant's legs.

In the past, the webs were typically processed at a rate of around six hundred feet per minute in disposable diaper manufacturing lines. In an effort to further reduce manufacturing costs, it has now been proposed to process the webs at around eight hundred to one thousand feet per minute. Additionally, new web materials utilized in disposable diapers will require that the webs be run at extremely low tensions, for instances, at one-half to one pound total, on a twenty-inch wide web, or at approximately 0.025 pli (pound per linear inch). The total tension must be held within plus or minus one-quarter pound to avoid inelastic deformation of the web materials.

The maintenance of such relatively low tensions and relatively high processing speed is complicated by the fact that a web must be brought to a complete stop each time a splice is made. At the processing speeds contemplated, this stoppage of the web to accomplish a butt splice must occur relatively frequently. No prior apparatus or methods were known that were capable of handling webs within these specifications, and particularly capable of handling webs of materials utilized to manufacture disposable diapers.

SUMMARY OF THE INVENTION

In principal aspect, the present invention relates to an improved method for forming an accurate, zero-speed butt splice or joint and to an improved apparatus suitable for expeditiously performing the method while the webs are being continuously processed, downstream of the splicing apparatus, at relatively high speeds and under relatively constant, relatively low tensions. By using the improved method, a web from a new roll of material may be easily, quickly and accurately joined to a web which is from an expiring roll of material and which continues to be run at relatively high speeds, downstream of the roll, under relatively low tension, along a predetermined path of travel that includes a running web storage means, such as a web storage festoon. While a wide variety of materials may be butt spliced together, the 15 improved method and apparatus of the present invention are especially suited for the splicing of the webs of materials used in the making of disposable diapers. Further, the webs can be run in disposable diaper manufacturing lines at speeds of eight hundred to one thousand feet per minute under tensions of 0.025 pli (that is, one-half to one pounds total) on a twenty inch wide web, while zero-speed splices are being made. Because of the significantly increased manufacturing line speed, these butt splices must be made more frequently, and the improved method and apparatus have been able to save a number of diapers per splice that would have otherwise had to be discarded using heretofore conventional splicing apparatus.

The improved method and apparatus of the present invention afford a number of other important commercial advantages. Minimum operator involvement is required to run the apparatus of the present invention, and thus accomplish a good quality butt splice. As noted, the improved methods and apparatus may utilize a zero-speed splicing concept, that is, the expiring or old web is brought to a stop during the actual splicing of the new web to the expiring web. Nevertheless, due to the short time required to form the butt splice and the use of the running web storage means, the web processing operation can continue at relatively high speeds as material is drawn from the running web storage means during the splicing operation. Thus, the use of the improved method and apparatus enable significantly increased production to be achieved in terms of the overall speed of the disposable diaper manufacturing line.

Accordingly, it is an object of the present invention to provide an improved method for forming a good quality butt splice by holding a portion of the web from the new roll against an anvil that includes a cutting edge disposed at an angle to the path of travel of the expiring web running past the anvil. The portion of the new web is then trimmed or cut along the cutting edge of the anvil so that the trimmed edge of the downstream, leading end of the new web is aligned with and conforms to the anvil's cutting edge. Single-sided adhesive tape is then applied to the leading trimmed end so that a portion of the tape extends downstream beyond the anvil's cutting edge and the trimmed end of the new web. The web from the expiring roll is then momentarily stopped, a portion of that web is held against the anvil; that portion of the expiring web is trimmed or cut along the anvil's cutting edge, and the trailing end of the expiring web is pressed against and adhered to the downstream portion of the tape so that the leading end of the new web and trailing end of the expiring web are secured or joined together by the tape. The joined new and expiring webs are then permitted to run again through the running web storage means and to the web processing operation such as in a disposable diaper manufacturing line.

Another object of the present invention is to provide an improved method, as described, where the portion of the expiring web is trimmed and the trailing end is adhered to the downstream portion of the tape substantially simultaneously. A related object is to provide an improved method, as described, where the leading end of the new web and the downstream portion of the tape are supported during the time the portion of the expiring web is trimmed and its trailing end is pressed against and adhered to the downstream portion of the tape.

A further object of the present invention is to provide an improved method for forming a butt splice, as described, between the trailing end of an expiring roll and the leading end of a new roll of web materials used in the manufacture of disposable diapers, where the diameter of the expiring roll is calculated; where a splice is initiated when the roll diameter has run down to a preselected limit; where the expiring roll is stopped and the expiring web is clamped adjacent to the anvil upon initiation of the splice; where the portion of the expiring web is cut along the anvil's cutting edge, a part at a time, across the expiring web and beginning at one side edge thereof, so that the point of cutting moves across the portion of the expiring web from one side edge to the other side edge, so that the uncut part of the portion of the expiring web remains under tension ahead of the point of cutting and so that the cut part of the portion of the expiring web, behind the point of cutting, is adhered to the adhesive tape on the leading end of the web of the new roll substantially simultaneously as the point of cutting moves across the portion of the expiring web; where the new web is unclamped and the new roll is quickly driven up to line speed upon completion of the cutting of the expiring web; and where the web speed is maintained at line speed as and after the festoon has been restored to its normal position. A related object is to provide an improved method, as described, for forming butt splices for webs of materials used in the manufacture of disposable diapers where the webs must be processed at relatively high speeds and under relatively constant, relatively low tensions in a disposable diaper manufacturing line.

A still further object of the present invention is to provide an improved apparatus that is suitable for performing the improved method as described and that can expeditiously form a good quality butt splice by trimming or cutting both the new and expiring webs along the same anvil cutting edge and by trimming the expiring web while simultaneously adhering the trimmed trailing edge of the expiring web to adhesive tape projecting downstream from the leading end of the new web. A related object of the present invention is to provide an improved apparatus as described, where the web need only be momentarily stopped, adjacent to the apparatus, to effect the formation of a good quality butt splice and so that through the use of a running web storage means, the remainder of the web can continue running uninterruptedly through the web processing operation during the entire splicing operation.

These and still other objects, advantages and aspects of the present invention are more fully set forth in the following detailed description of the preferred embodiment of the present invention.

DESCRIPTION OF THE DRAWINGS

In the detailed description of the invention, reference will be made to the accompanying drawings comprised of the following figures.

DETAILED DESCRIPTION OF THE PREFERRED EMBODIMENT

Figure 1:
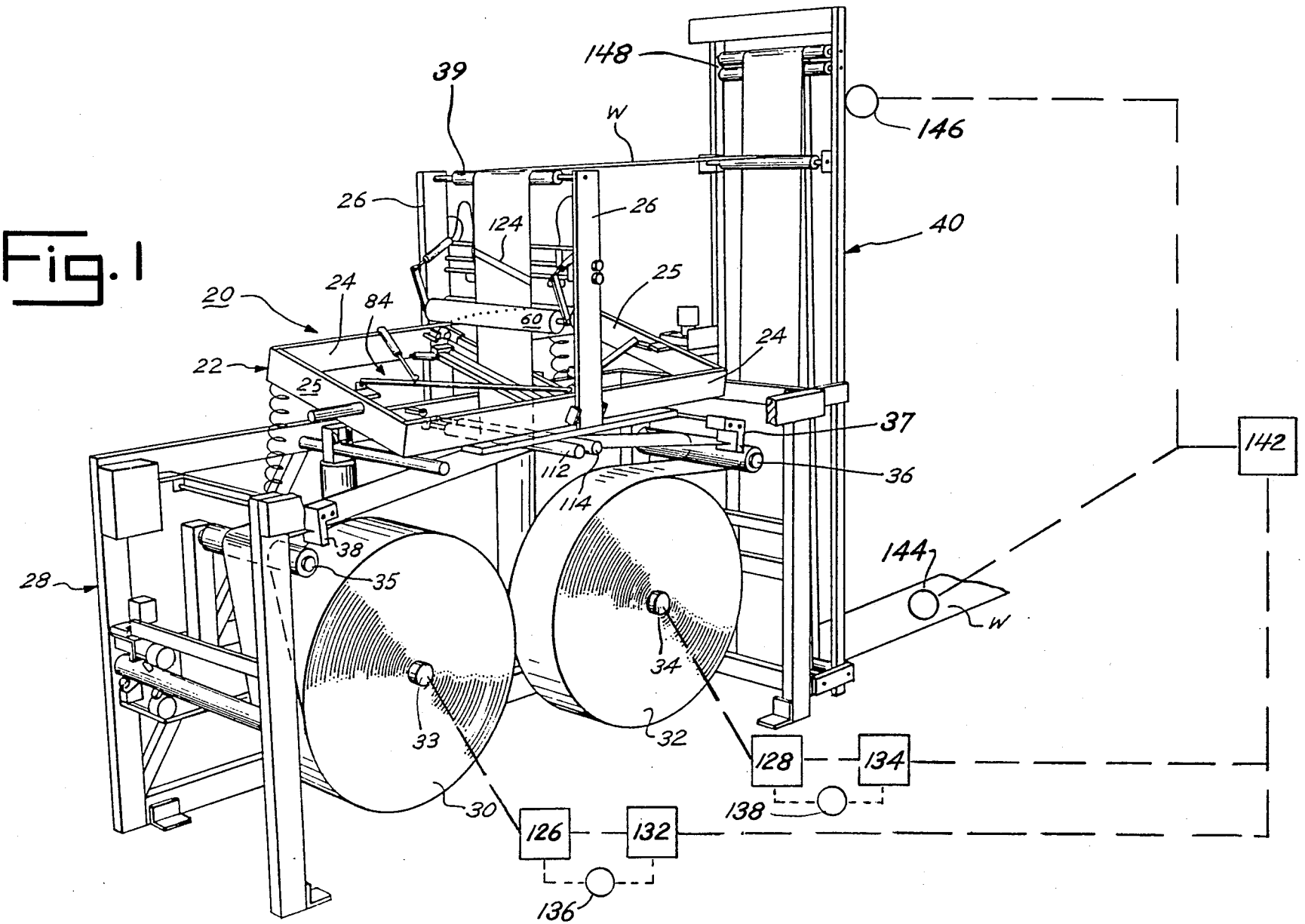
FIG. 1 is a front perspective view of a preferred embodiment of apparatus for performing the improved method of the present invention which apparatus is shown mounted on a stand for holding the rolls of web material and associated with a web storage festoon.
Figure 2:
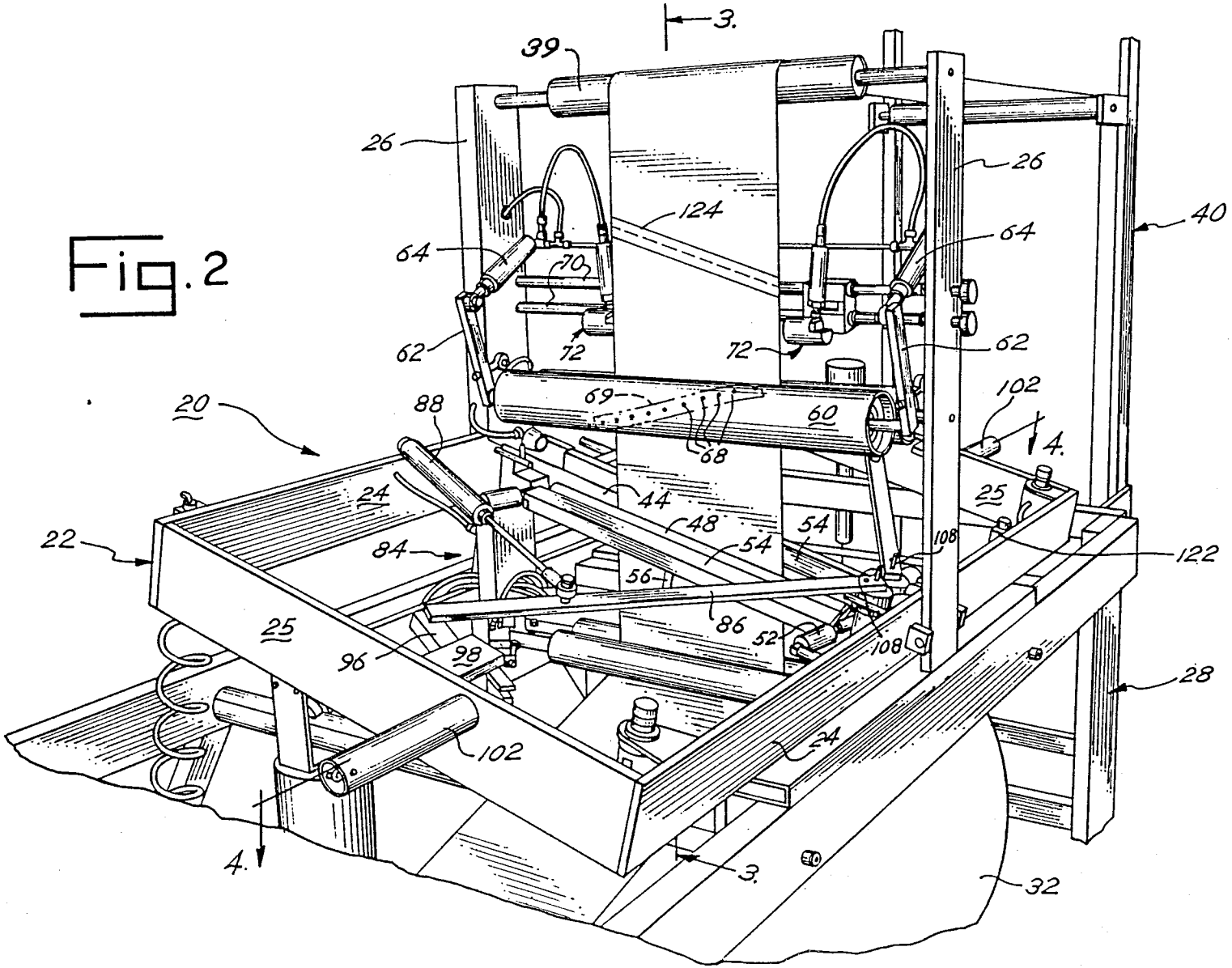
FIG. 2 is an enlarged, front perspective of the apparatus of FIG. 1.

Referring now to FIGS. 1 and 2, the preferred embodiment of the improved apparatus of the present invention is generally designated at 20. This apparatus includes an open, generally rectangular frame 22 comprised of two side members 24 and two end members 25 that are secured together at their ends. A vertical upright member 26 is secured, at its lower end, to each of the side members 24, midway between the end members. The upright members 26 project upwardly from the plane of the frame 22.

A stand 28 supports the frame 22. The frame 22 is disposed on the support stand 28 at an angle, preferably 15 degrees, with respect to the horizontal so that one side member 24 is higher than the other. Two web rolls 30 and 32 of material are also mounted on the stand 28 on horizontally disposed spindles 33 and 34, respectively. U.S. application Ser. No. 193,290 filed May 5, 1988, now U.S. Pat. No. 4,856,960 describes a stand that may be used as the stand 28. The frame 22 is supported directly above the rolls.

The web rolls 30 and 32 may contain a web of a variety of materials such as paper, film, foil, laminate, etc., wound about a central core or spool. However, the apparatus 20 has particular utility with regard to the splicing of two-ply, pressure-sensitive label stock.

Idler rollers 35 and 36 and conventional mechanisms 38 and 37 for aligning and adjusting the position of a web are associated with the web rolls 30 and 32, respectively, and are also mounted on the stand 28. The leading ends of both web rolls 30 and 32 may be fed around their associated rollers 35 and 36, through their associated mechanisms 38 and 37, respectively, and to the apparatus 20 although when used with a disposable diaper manufacturing line, these rollers and mechanisms may be omitted.

Normally the web from only one of the web rolls 30 and 32 is running. This running web (indicated generally by the letter "W") passes, under tension, vertically through the apparatus 20 and except during the splicing operation, does not engage the apparatus. After passing through the apparatus, the running web W turns about an idler roll 39 that is mounted at and between the upper ends of the members 26. It then may pass to and through a conventional web storage festoon assembly shown generally at 40. Alternatively and preferably, the assembly 40 should be made in accordance with the teaching of U.S. Pat. Nos. 3,659,767 and 4,519,858 and should include an inertia compensated festoon assembly comprising a first, upstream inertia compensated festoon having multiple "floating" dancer rollers and a second downstream, inertia compensated festoon having a single "floating" dancer roller. A controlled, driven isolation roller is closely disposed between the first and second festoons. Such festoons function in accordance with the teachings of U.S. Pat. No. 3,659,767 and may be structurally identical to those festoons manufactured by Martin Automatic, Inc. of Rockford, Ill. Such a combined inertia compensated festoon is described in greater detail in co-pending U.S. application, Ser. No. 302,475 that was filed on Jan. 26, 1989, that is assigned to the assignee of this application and that is incorporated herein by reference thereto.

In essence, the assembly 40 functions as an accumulator for the running web. It maintains a constant tension on the running web downstream of the assembly 40 and permits the web to keep running, downstream from the assembly, for a period of time after the web has been stopped upstream from it. The tension set on the web depends on the position of the dancer rollers, vis-a-vis their associated idler rollers. When the running web W exits from the assembly 40, it proceeds to a web processing means, not shown, such as a disposable diaper manufacturing line. The assembly 40, and particularly its preferred form, permits the web W to be run at the aforesaid relatively high speed and under the relatively constant, relatively low tension required for the manufacture of disposable diapers.

As the web roll that is feeding web to the press expires, the apparatus 20 may be operated to expeditiously join, in a good quality butt splice, the leading end of the new web roll to the trailing end of the expiring web roll so that web can uninterruptedly and continuously be fed to the web processing means. The web from the expiring web roll momentarily stops while the splicing operation takes place. During this brief stoppage, web continues, however, to feed from the festoon assembly 40 to the web processing means so that at all times, web is running, under tension, to and through the processing means. Thus, the splicing operation does not cause any loss of material due to stoppage of the processing means nor any loss of production time.

As best seen in FIGS. 3 and 6–9, an anvil 44 extends from one side of the frame 22 to the other and is secured, at its ends, to the side members 24 midway between their ends. The plane of the anvil is vertical and is perpendicular to the plane of the frame. Its leading or downstream "edge" (in terms of the web flow) defines a cutting edge 46 which is wider than the width of the web. The cutting edge 46 is used to trim or cut the expiring and new webs as explained hereinafter.

The anvil 44 is disposed so that it is adjacent to the path of travel of the running web as it passes through the apparatus 20. The sides of the anvil 44, upstream from the cutting edge 46, are substantially parallel to this path of travel and to each other.

A pivotable nip roll 48 is positioned adjacent to each side of the anvil 44. Each nip roll is adapted to selectively be pressed against the side of the anvil so that a web may be held against the anvil during the splicing operation. The structure and function of the two nip rolls 48 are identical, and thus the same reference numerals are used in describing them.

As best illustrated in FIGS. 3–11, each of the nip rolls 48 extends substantially along the entire adjacent side of the anvil 44. The length of the nip roll is greater than the width of the web. Its ends are journaled in bearings 50. Each of the nip rolls 48 may be pivoted between a first position, such as shown in the left hand side of FIG. 3, where the nip roll is spaced from the adjacent side of the anvil 44 and a second position, such as shown in the right hand side of FIG. 3, where the nip roll presses against the side of the anvil 44. When a nip roll 48 is in its first position, the web may freely run between it and the adjacent side of the anvil. When a nip roll is in its second position, the nip roll serves to hold or clamp the web between it and the adjacent side of the anvil.

Two pneumatic, double acting power cylinders 52 are associated with each nip roll 48, with one power cylinder 52 being connected with each end of the nip roll. More specifically and as best seen in FIGS. 6–9, the rod end of each power cylinder 52 is pivotally connected with a member 55 which, in turn, has one end pivotally connected with the end of the nip roll 48. Each of the other ends of the power cylinders 52 is pivotally connected with a bracket 53 that is mounted on the side members 24. The two power cylinders, connected to the opposite ends of a nip roll 48, can move that nip roll between its first and second positions and urge the nip roll tightly against the adjacent side of the anvil 44 when in its second position.

Two backup bars 54 are mounted, adjacent to their ends, to the other ends of the members 55 for pivotal movement about an axis parallel to the longitudinal axes of the anvil 44 and the nip rolls 48. Like the nip rolls, the backup bars 54 are identical in structure and function, and the same reference numerals are used in describing them.

Figure 7:
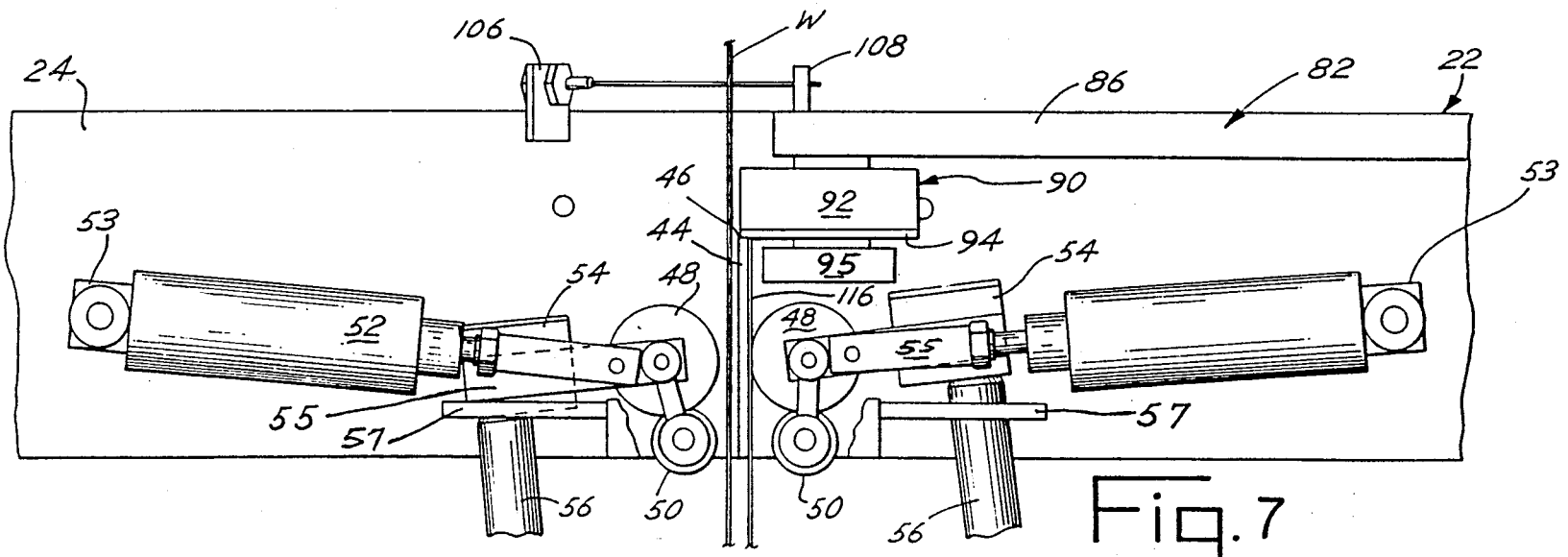

Each of the backup bars 54 is adapted to move and be pivoted between: a first position, such as shown in the left hand side of FIG. 7, where it is spaced from the adjacent side of the anvil 44 and where it rests on and is supported by roll pins 57 mounted on the side members 24; a second position, such as shown on the right hand side of FIG. 7; and a third position. When in its third position, the backup bar 54 abuts the adjacent side of the anvil 44 and the cutting edge 46 such as shown in the right hand side of FIG. 8. A portion of the backup bar extends beyond or downstream from the cutting edge 46 so as to provide a backup or support for a piece of adhesive tape as hereinafter described. When the backup bar 54 is in its first position, the web may freely run between it and the adjacent side of the anvil. Each backup bar 54 has a handle 56 that may be used by the operator to move the backup bar between its positions.

Figure 3:
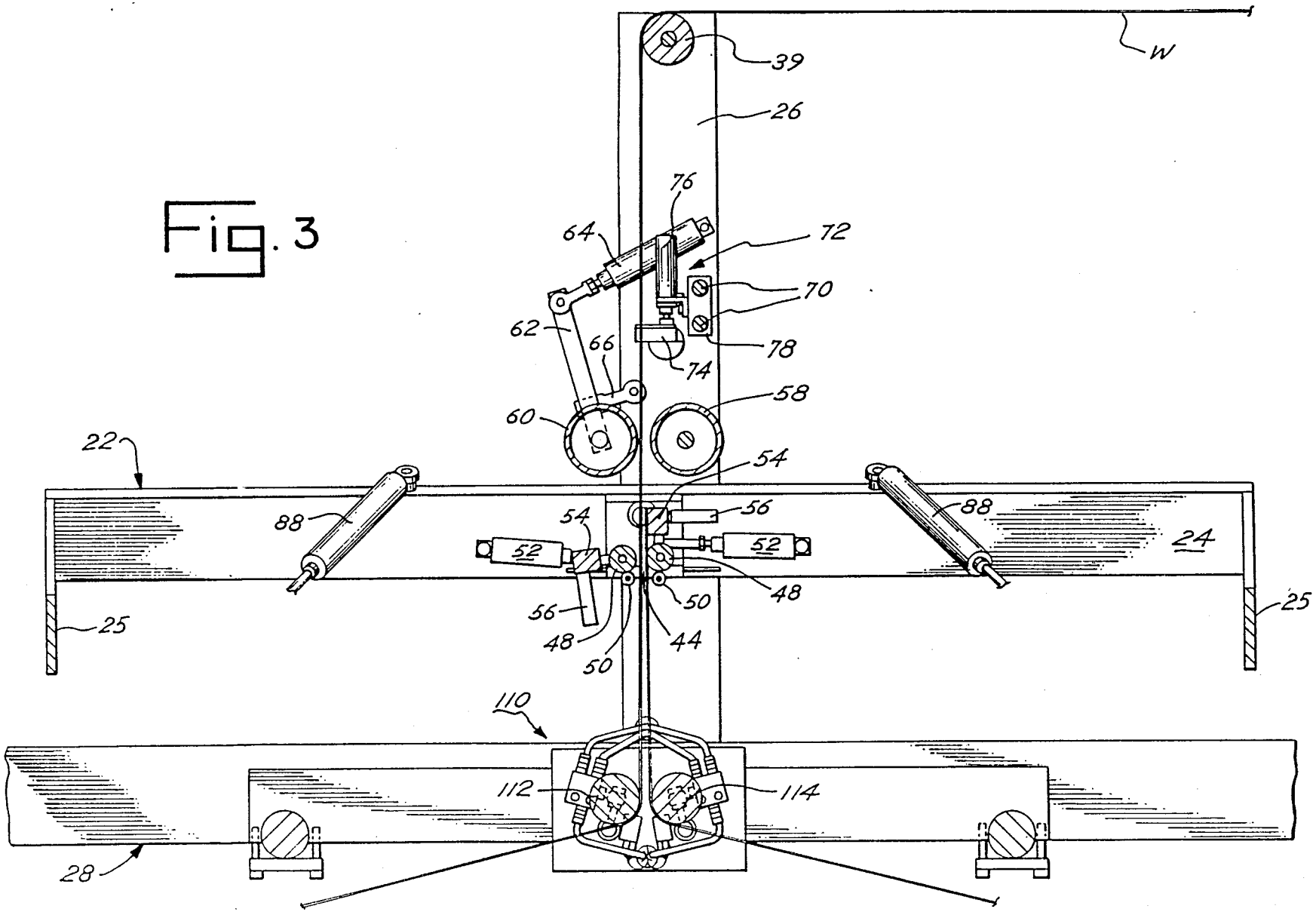
FIG. 3 is a partial cross-sectional view taken along the line 3—3 in FIG. 2.
Figure 10:
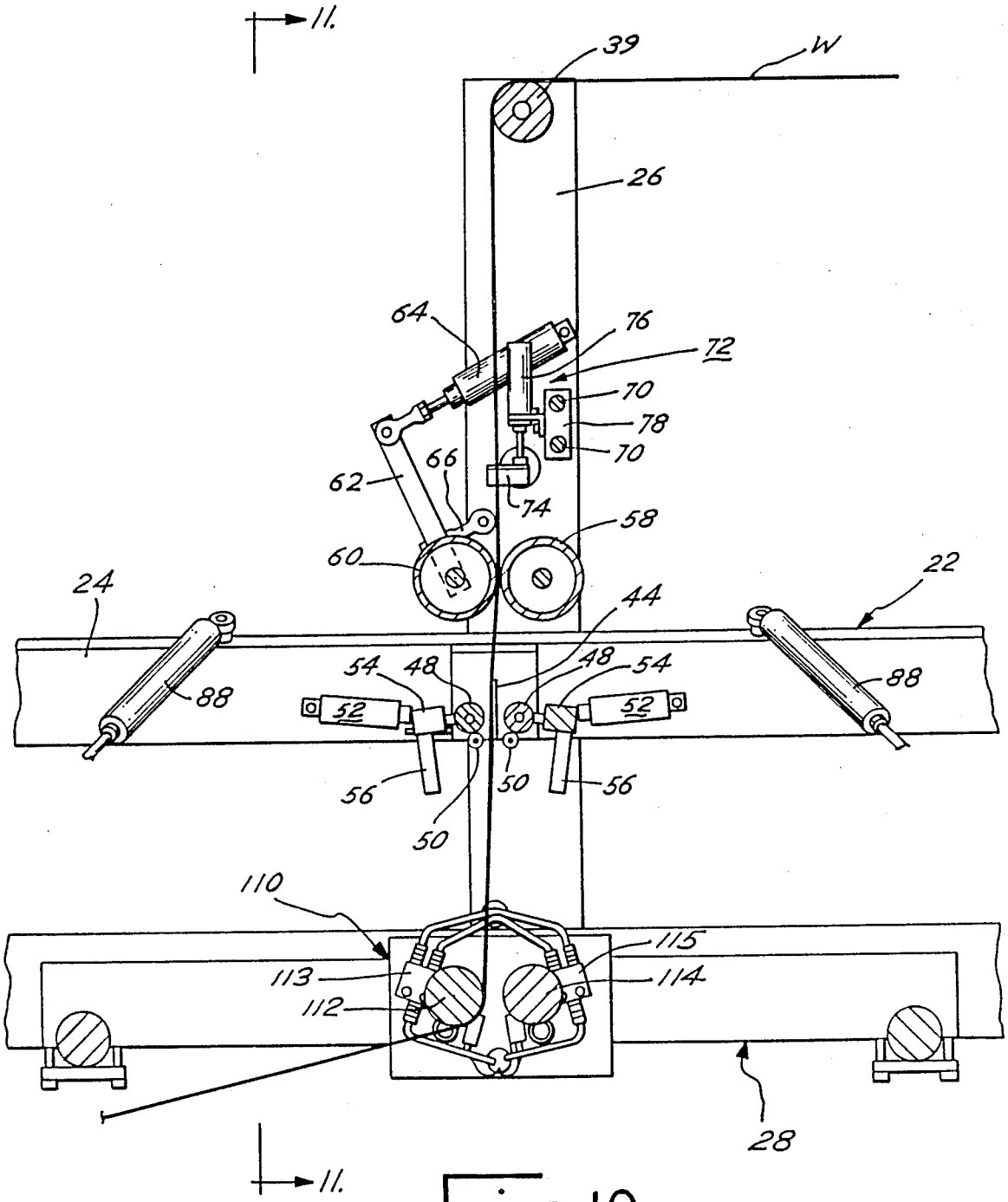
FIG. 10 is a cross-sectional view similar to FIG. 3 and illustrating the application of the second piece of tape to the butt splice as the butt splice moves away from the anvil.

Referring now to FIGS. 3 and 10, a pair of tubular vacuum rolls 58 and 60 are mounted for rotation between the upright numbers 26. Vacuum roll 58 is mounted for rotation, about a fixed central longitudinal axis. Vacuum roll 60 is, however, movable between a first position, such as shown in FIG. 3, where the periphery of the vacuum roll is spaced from the web W as it passes through the apparatus 22 and a second position, such as shown in FIG. 10, where the web is tightly pressed between periphery of the vacuum roll 60 and the periphery of the vacuum roll 58.

Each end of the vacuum roll 60 is supported by identical assemblies, and only one will be described in detail. More specifically, each end of the vacuum roll 60 is supported, for rotational movement about its central longitudinal axis, at one end of a mounting bar 62. The other end of each of the mounting bars 62 is pivotally connected with the rod end of a pneumatic double acting power cylinder 64. The other end of each of the power cylinders 64 is pivotally connected with its adjacent vertical member 26. An arm 66 is pivotally connected, at one end, with the adjacent member 26 and at its other end, with the member 62 between its ends. Actuation of the two power cylinders 64 causes the members 62 to pivot about the other ends of the arms 66 and thus moves the vacuum roll 60 between its first and second positions.

Each of the vacuum rolls 58 and 60 have a plurality of small holes in its periphery, as indicated at 68 in FIG. 2. These holes 68 are arranged in a spiral pattern from one end of each vacuum roller to the other. The interiors of the vacuum rolls are connected with a source of vacuum by conventional means, not shown. A piece of single sided adhesive tape, shown in phantom line at 69 in FIG. 2, may be laid over the holes 68, with its adhesive side facing radially outwardly, and held on and about the periphery of one of the vacuum rolls by the vacuum prior to and during the splicing operation. The vacuum rolls 58 and 60 and their associated actuating parts and functions may be omitted when the apparatus 20 is being used with a disposable diaper making line.

As best illustrated in FIGS. 2–3, 10 and 11, a pair of metal bars 70 extend between the upright members 26 above or downstream from the vacuum rolls 58 and 60. These bars support two web-side trimming assemblies 72, one adjacent to each side edge of the running web W. The bars 70 are positioned to the side of the path of the travel of the web W and do not interfere with the web as it passes through the apparatus 20.

Each of the two side-web trim assemblies 72 are structurally and functionally the same, and for that reason, the same reference numerals are used in describing them. Each includes a trimmer head 74 that carries a cutting blade adapted to trim any material, like tape, that extends beyond the side edge of the running web W. Each of the trimmer heads 74 is mounted on the rod end of a pneumatic single acting, spring return power cylinder 76. They may be moved between a first position where the trimmer heads are spaced from the running web W and its path of travel and a second position where the trimmer heads are adjacent to the side edges of the web as it runs through the apparatus 20. Actuation of the power cylinders 76 causes the trimmer heads 74 to be moved between their first and second positions.

Two bracket block assemblies 78 are slidably mounted on the bars 70. Each serves to mount one of the power cylinders 76 on the bars 70. The trimmer heads 74 and their associated components and functions may be omitted when the apparatus 22 is used with a disposable diaper manufacturing line.

As noted above, the idler roll 39 is mounted for rotation between the upper ends of the members 26. The path of travel of the web W changes direction as the web passes about the roll 39 from a vertical path, assumed as it passes through the apparatus 20, to a horizontal path as it enters the festoon assembly 40.

Figure 4:
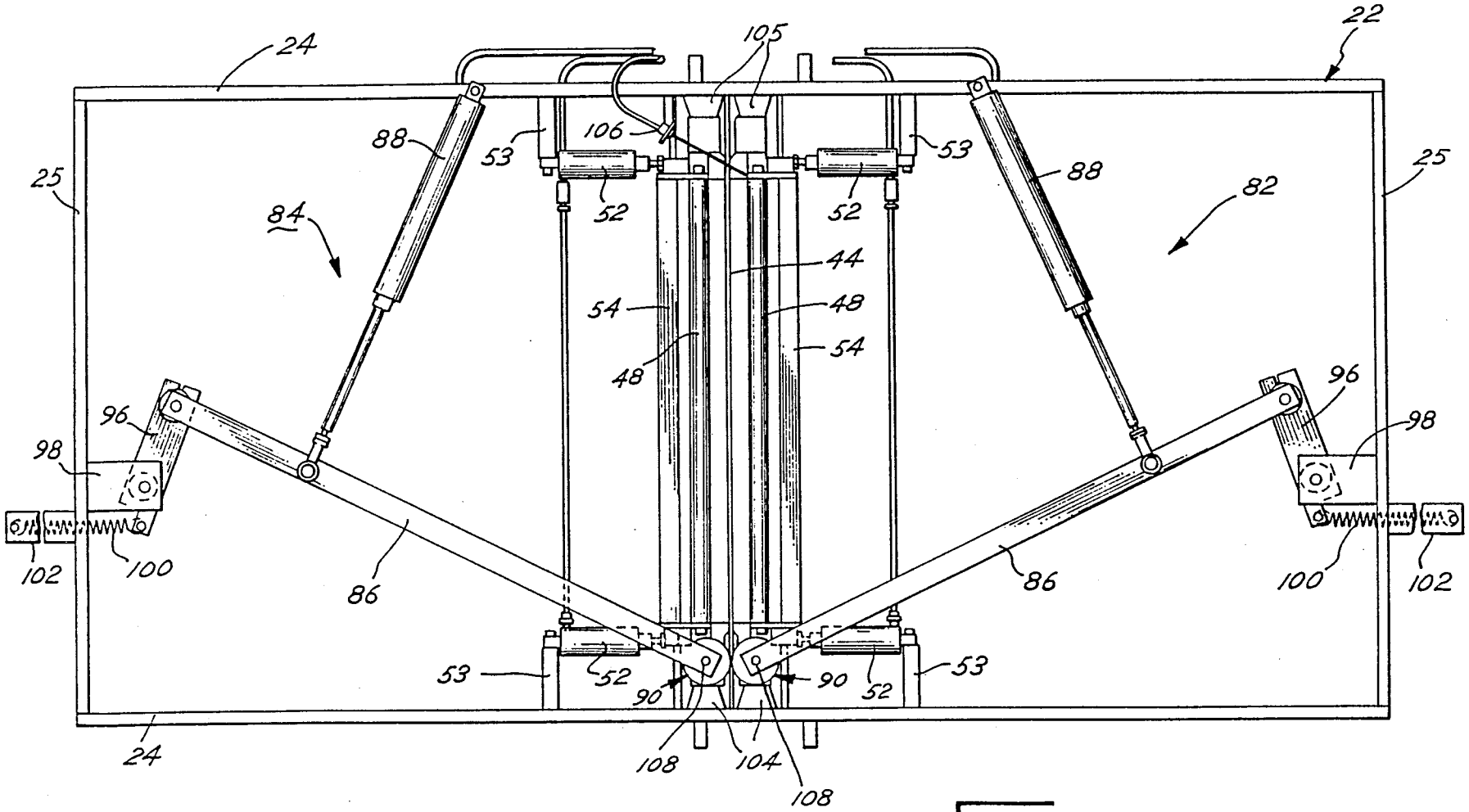
FIG. 4 is cross-sectional view taken along the line 4—4 in FIG. 2.
Figure 5:
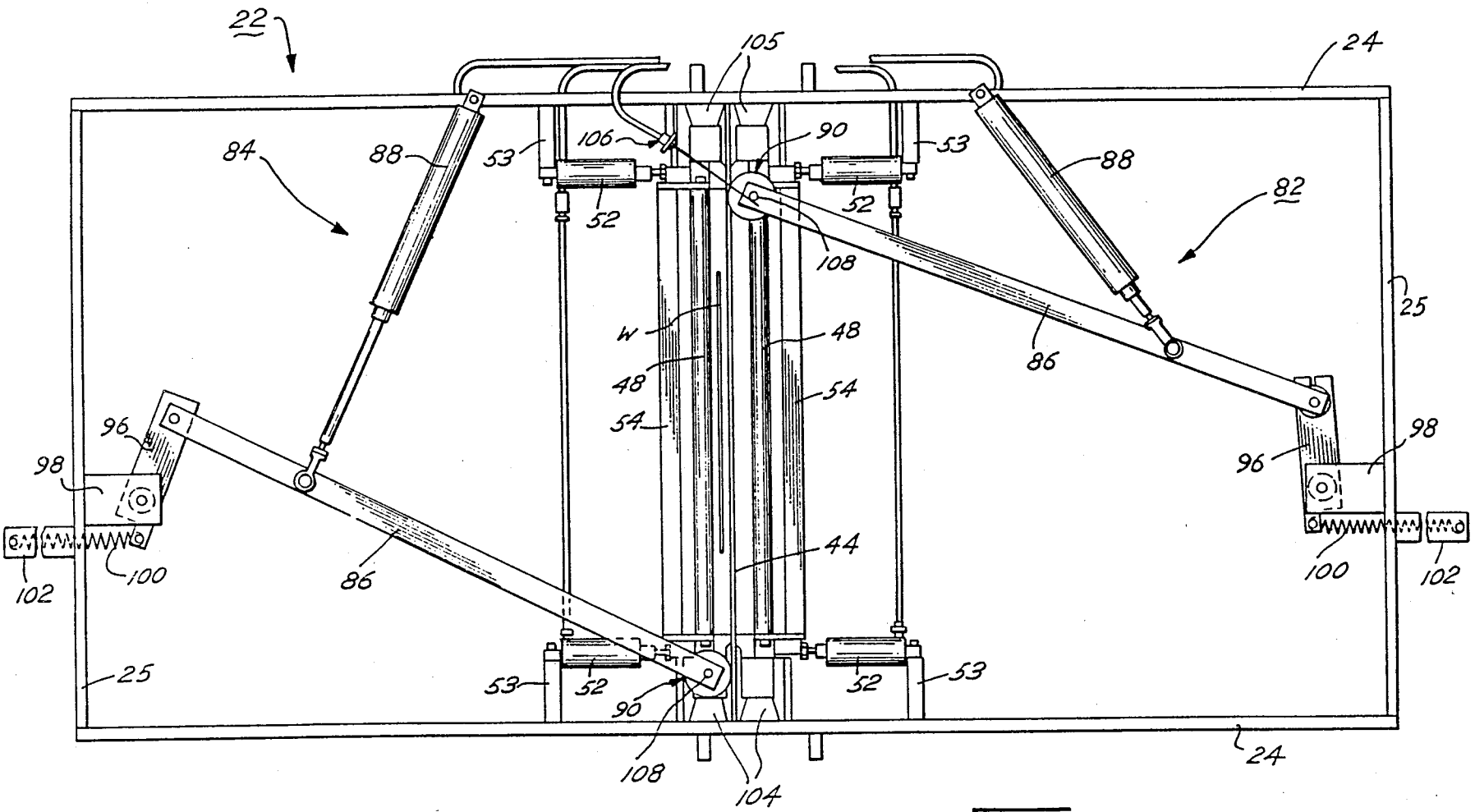
FIG. 5 is cross-sectional view, similar to that in FIG. 4, wherein the right hand arm mounted cutter is shown in its other position.
Figure 6:
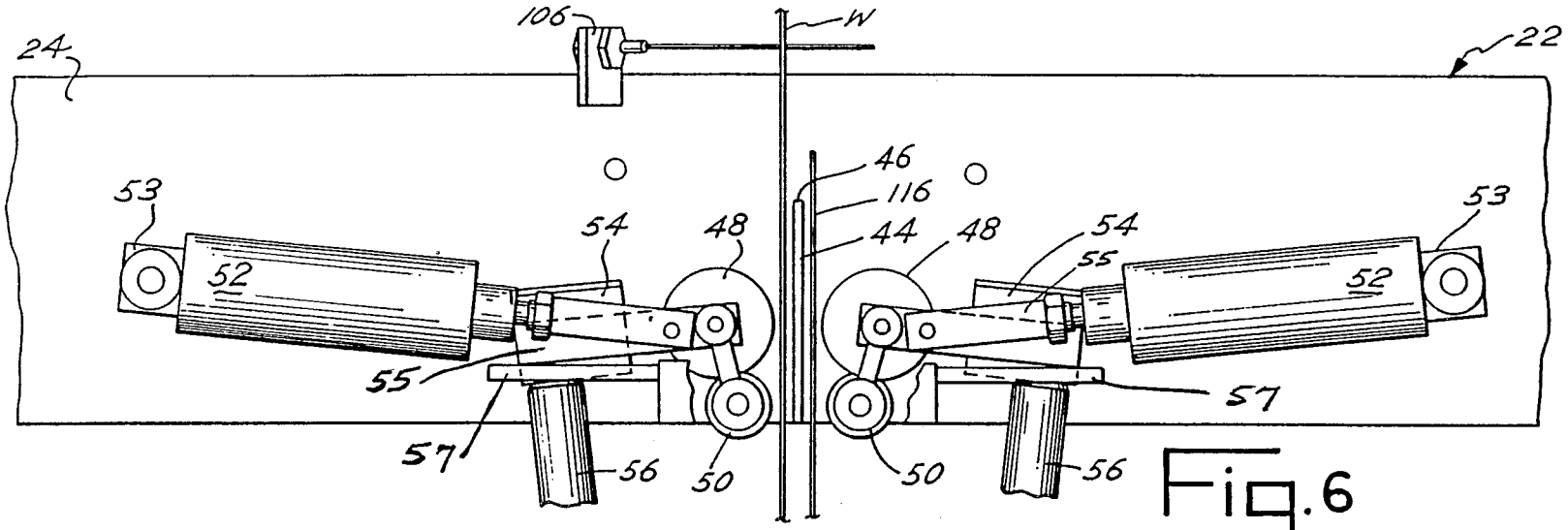
FIGS. 6–9 are similar, vertical cross-sectional views, taken transverse to the axes of the cutting edge of the anvil of the apparatus of FIG. 1, and illustrating various positions of the circular roller knives, and the web backup bars during the formation of the butt splice.

Referring now to FIGS. 4 and 5, splice wheel arm assemblies 82 and 84 are shown mounted on the frame 22. During the splicing operation, one of these assemblies 82 or 84 is used to trim or cut the leading edge end of the web from the new roll. The other assembly 84 or 82 is then used to trim or cut the web from the expiring or old roll while simultaneously pressing the trimmed, trailing end of the expiring roll against adhesive tape previously applied to the leading end of the web from the new roll. Which of the assemblies 82 and 84 does which function in any particular splicing operation depends on the location of the new and expiring web roll on the support stand 28. In other words, the splice wheel arm assembly located immediately above the new web roll will be the assembly used to trim or cut the leading end of the new roll. The other assembly, that is, the one immediately above the expiring web roll, will be then used with the web from the expiring web roll.

The two assemblies 82 and 84 are identical in structure, and accordingly, the same reference numerals are used in describing them. Each includes a splice wheel arm 86. The rod end of a pneumatic single acting power cylinder 88 is pivotally connected with the arm 86 intermediate its ends. The other end of the power cylinder 88 is pivotally connected with the upper one (as shown in FIGS. 4 and 5) of the side members 24. The point of connection between the power cylinder 88 and the side member 24 is approximately one third of the way between the anvil 44 and the adjacent end member 25.

Figure 9:
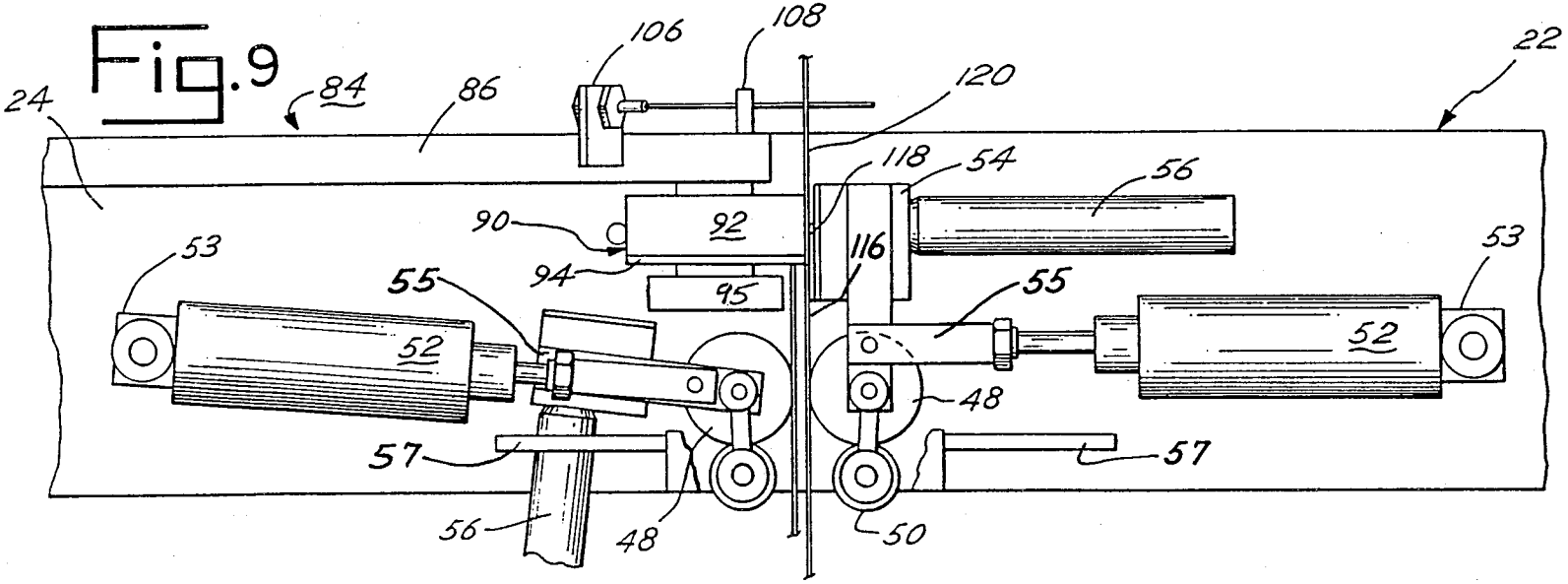

A knife wheel assembly 90 is mounted on one end of the arm 86 and is disposed next to the adjacent side of the anvil 44. As best seen in FIGS. 7 and 9, the assembly 90 includes a roller 92 that is disposed, in relation to the anvil 44, so that its lower or upstream edge is positioned just above or downstream from the cutting edge 46 of the anvil. The roller 92 rotates about an axis parallel to the side of the anvil 44.

The bottom or upstream side of the roller 92 constitutes a rotary, round knife or cutting edge, indicated at 94 in FIGS. 7 and 9. This rotary edge 94 is aligned with the cutting edge 46. The plane of the rotary edge 94 is perpendicular to the plane of the side of the anvil 44. The rotary edge 94 rotates with the roller 92 and trims or cuts the web, along the cutting edge 46, when a web is adjacent to its side of the anvil and when the assembly 90 is moved along the cutting edge 46.

As illustrated in FIGS. 7 and 9, the assembly 90 also includes a depending cylindrical bearing member 95 that is carried by the roller 92 below its lower edge. The bearing member 95 rotates about the same axis as the roller 92. The diameter of its outer bearing surface is such that when the roller 92 is positioned as shown in the right hand side of FIG. 7, its bearing surface abuts and is in contact with the adjacent side of the anvil 44. The bearing surface thus holds the web against the side of the anvil while the web is being trimmed. The bearing member 95 also serves to guide the assembly 90 along the anvil 44 during the trimming of the new web.

The other end of the arm 86 is connected, for limited pivotal movement, with a bearing block 96. A pivot block 98 is secured to the adjacent end member 25 of the frame 22 and is pivotally connected with the bearing block 96, intermediate its ends, so that the bearing block 96 may pivot about this point of connection. The other end of the bearing block 96 is attached, by a pin, to one end of a coil extension spring 100. The other end of the spring 100 is received within one end of a hollow spring tube 102 and is connected to the other, projecting end of the tube. The spring tube 102 is mounted in a hole in the member 25. The spring 100 exerts a force on the bearing block 96 and tends to bias the other end of the bearing block 96 away from the adjacent end member 25 which, in turn, biases the knife wheel assembly 90 toward the anvil 44.

Actuation of the power cylinder 88 of the assembly 82 causes its knife wheel assembly 90 to move from a first position, as shown in FIG. 4, where the assembly 90 was adjacent to the lower, side member 24 to a second position, as shown in FIG. 5, where the assembly 90 is adjacent to the upper side member 24. Such actuation of the cylinder 88 causes relatively rapid movement of the assembly 90 from its first position to its second positions.

The assembly 82 may be returned to its first position, as shown in FIG. 4, from its second position, as shown in FIG. 5, by the operator manually moving the assembly. The assembly 84 may be moved between its first and second positions in a similar fashion.

When the assemblies 82 and 84 are in their first positions, as shown in FIG. 4, the rollers 92 abut and rest against stops 104 that are secured to the inside of the adjacent side member 24. Similar stops 105 are secured to the inside of the other side member 24, and the rollers 92 abut against them when the assemblies are in their second positions.

A conventional whisker valve 106 is mounted on the inside of the upper, side member 24 as illustrated in FIGS. 4 and 5. In each of the assemblies 82 and 84, a vertically disposed pin 108 is mounted on the one end of arm 86 (that is, the end that carries the knife wheel assembly 90) and projects upwardly above the arm 86 and the assembly 90. The "whisker" portion of the valve 106 extends across the path of movement of the assembly 90 and is actuated by the pin 108 when an assembly 82 and 84 is moved to its second position.

Figure 11:
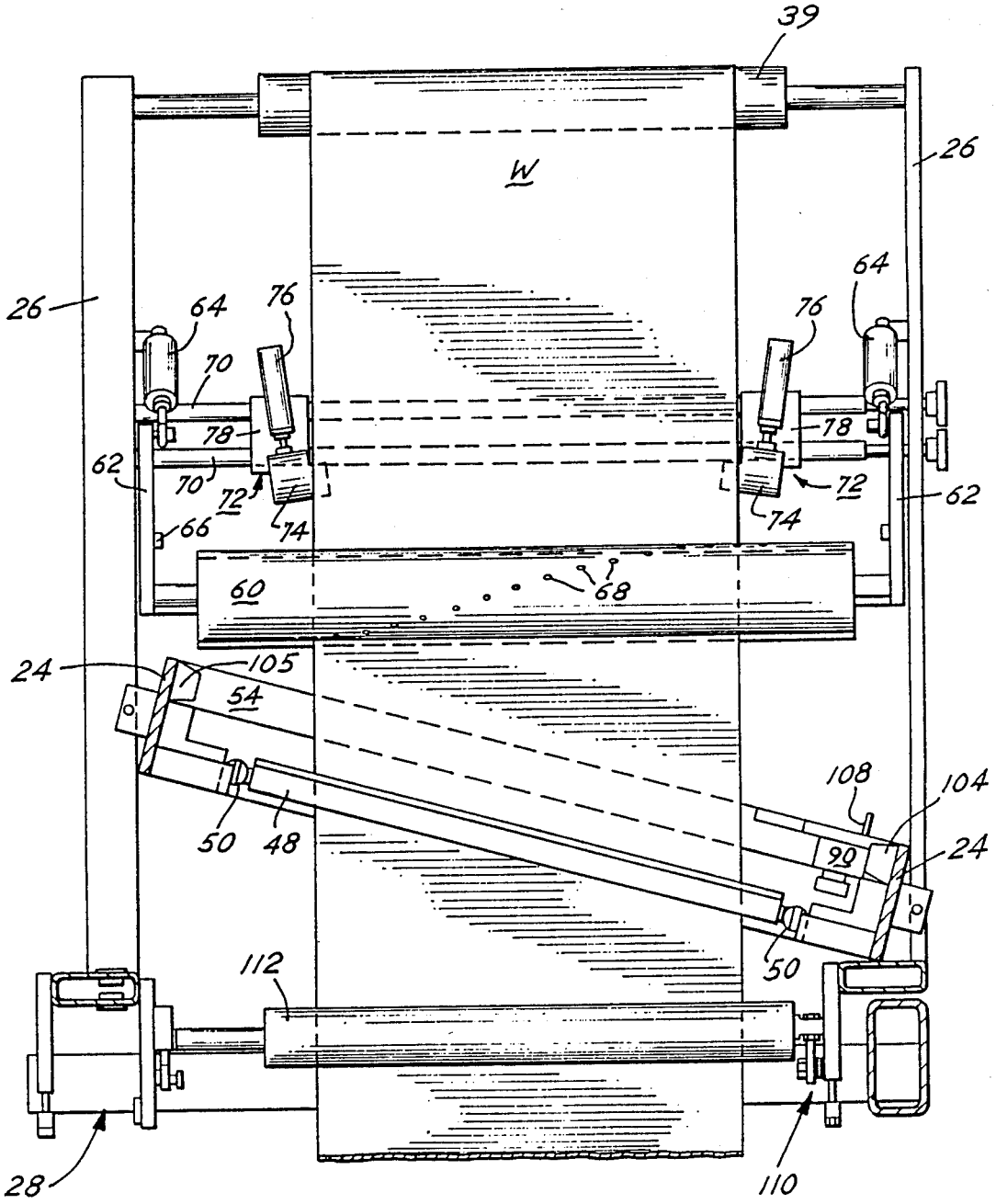
FIG. 11 is a partial front elevational view taken along the line 11—11 in FIG. 10.

As best shown in FIGS. 1, 10 and 11, a conventional drop roll assembly 110 is mounted on the stand 28 immediately below or upstream from the anvil 44. The assembly 110 includes a pair of drop rolls 112 and 114 that are, in turn, connected with their associated, conventional valves 113 and 115, respectively. These drop rolls 112 and 114 serve to direct the web coming from the web rolls 30 and 32 respectively, to a vertical path of travel that extends past the anvil 44 and to the idler roll 39. This assembly 110 need not be included, however, when the apparatus 20 is used with a disposable diaper making line.

A butt splice may be performed using the apparatus 20 as follows: When the web processing means is operating, web is being fed from one of the web rolls 30 or 32, for example, web roll 30. This web runs through the apparatus 22, over the idler roll 39, through the festoon assembly 40, and to and through the web processing means or other web handling device downstream from the assembly 40. While the web is thus running, the normal practice is to mount a new, full web roll, for example web roll 32, on the spindle 34 so that the new web roll 32 will be ready when the "running" roll 30 expires. In anticipation of the actual splicing operation, the leading end of the new web roll 32 is manually brought adjacent to the right side of the anvil 44 as shown in FIGS. 6–9. In this regard, it should be noted that the running web from the web roll 30 is then moving past the left side of the anvil as shown in FIGS. 6–9.

The leading end of the new web, indicated by the reference numeral 116 in FIGS. 6–9, is then trimmed or cut by the knife wheel assembly 90 of the splice wheel arm assembly 82. Before the end 116 is trimmed, the assembly 82 is in its second position, that is, the position shown in FIG. 5 where the assembly 82 is disposed adjacent to the upper, side wall 24. To trim the leading end 116, the assembly 82 is manually moved from its second position to its first position by the operator. Normally the operator stands adjacent to the lower, side member 24, as seen in FIGS. 4 and 5, grasps the arm 86 and pulls the assembly 82 toward him.

As the assembly 82 moves away from the stop 105, the whisker valve 106 is returned to its normal position. This actuates the power cylinders 52 connected with nip roll 48 associated with the assembly 82. The actuation of these power cylinders 52 cause the nip roll 48 to be pivoted counterclockwise, as seen in FIGS. 6–9, about their bearings 50 and to clamp the leading end 116 against the adjacent side of the anvil 44. As the assembly 82 continues to move to its first position and as best illustrated in FIG. 7, its rotary edge 94 trims or cuts the leading end 116 along the cutting edge 46. Thus the leading edge of that end 116 is aligned and made congruent with or conforming to the cutting edge 46 of the anvil 44.

Figure 8:
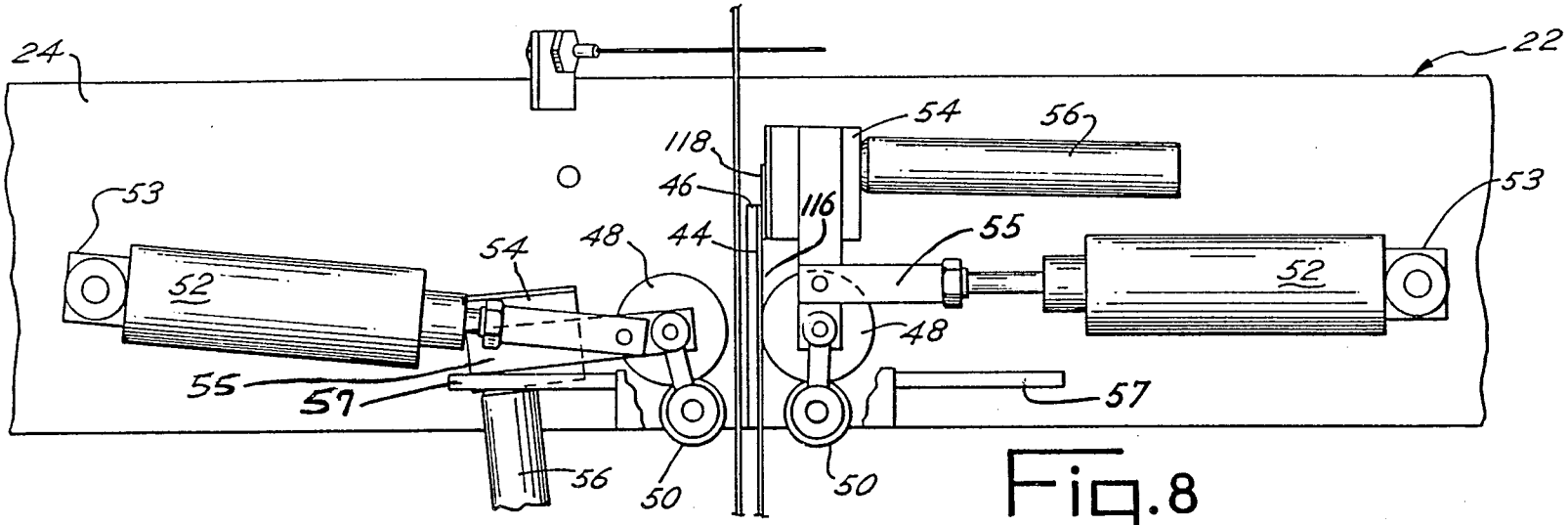

After the leading end 116 has been trimmed, the operator then puts a piece of single sided adhesive tape 118 on the leading edge of the end 116. The tape is placed so that it extends from one side of the leading end 116 to the other, so that approximately one-half of the tape 118 projects beyond or downstream from the cutting edge 46 and the leading edge of the end 116, and so that the adhesive surface faces the anvil and the running web. As best shown in FIG. 9, this projecting portion of the tape 118 has a width less than the distance between the downstream edge of the roller 92 and the cutting edge 46 of the anvil 44. Next the associated backup bar 54 is moved to its third position, as shown in FIG. 8, wherein the backup bar, in part, abuts the adjacent side the anvil and supports the tape 118. The backup bar is pivoted to its third position by the operator grasping the handle 56 and manually moving the bar.

Additionally, the operator may also place a piece of single sided adhesive tape 69 on the vacuum roll 60. Although as noted above, such additional tape may be omitted when the web is used in a disposable diaper manufacturing line. The tape 69 overlies the holes 68, and its length is such that when applied to the web, it will extend from one side of the web to the other. As noted before, the tape 69 is placed on the vacuum roll 60 so that its adhesive side faces radially outwardly. The tape is held on the periphery of the vacuum roll 60 by the action of the vacuum within the roll.

Following conventional practices, the vacuum roll 60 is spaced above the cutting edge 46 and disposed so that the tape 69 will be applied to both the leading end 116 and the trailing end, indicated at 120 in FIG. 9, of the expiring web during the splicing operation. A tape, like tape 69, will be placed on the other vacuum roll 58 during the next splicing operation when the web roll 32 is the expiring roll.

The operator would then check to be sure that the assembly 84 is in its first position, that is, the position shown in FIG. 4. Normally the assembly 84 would be in that first position since the assemblies 82 and 84 are alternatively used to trim the leading ends of the new web rolls which are, in turn, alternatively mounted on the spindles 34 and 33. Thus during the previous splicing operation, the assembly 84 would have been manually used to trim the leading end of the then new web roll 30 and to do this, was moved from its second to its first position as described above with respect to assembly 82.

After these preparatory steps have been taken, the web on the expiring web roll 30 can be permitted to continue to run until the expiring web roll is about exhausted. When a splice is initiated, a brake is applied to the spindles 33 and 34, the power cylinder 52, which applies the nip roll 48 associated with the assembly 84 are actuated and then the power cylinder 88 of the assembly 84 is actuated, as well as the power cylinders 64 and 76. Actuation of the power cylinders 64 and 76 causes the vacuum roll 60 to be moved to its second position, as shown in FIG. 10, and the trimmer heads 74 to be moved to their second positions adjacent to the side edges of the web although as noted above, the vacuum rolls and the trimmer heads may be omitted when the apparatus is being used with a disposable diaper manufacturing line.

As noted, actuation of the power cylinders 52 for the associated nip roll 48 (that is, the nip roll on the left in FIGS. 6–9) causes this nip roll to be then pivoted about its bearings 50 to its second position which in turn, stops and holds the adjacent portion of the expiring web against the left, adjacent side of the anvil 44, as best seen in FIG. 9. Actuation of the cylinder 88 of the assembly 84 causes its knife wheel assembly 90 to be rapidly moved from its first position to its second position. Movement of the assembly 90 causes the rotary edge 94 to trim or cut the adjacent portion of the expiring web along the cutting edge 46 of the anvil 44. Simultaneous with the trimming, the roller 92 presses this now cut, downstream trailing end 120, against the portion of the adhesive tape 118 that projects downstream from the cutting edge 46 and the leading end 116 of the web. As a result, the tape 118 joins the abutting ends 116 and 120, and thus, the expiring and new webs. Because both of the ends 116 and 120 have been trimmed or cut along the same cutting edge 46, there is no overlap, and the ends closely abut one another to form a good quality splice.

As the knife wheel assembly 90 of the assembly 84 nears its second position, the pin 108, which it carries, trips the whisker valve 106. Actuation of the whisker valve 106 results in the sequential actuation of power cylinders 64 and 76 and retraction of both nip rolls 48 away from both sides of the anvil 44 so that the newly spliced web may again run through the apparatus 20, the festoon assembly 40 and the web processing means. As noted previously, the actual splicing, resulting from the movement of the assembly 84, occurs so quickly that the festoon assembly 40 can feed out web during this movement of assembly 84 whereby the web W never stops running through the web processing means.

As the joined ends 116 and 120 pass through the nip between the vacuum rolls 58 and 60 if these rolls are being used. Tape 69 on the vacuum roll 60 is applied to the side of the spliced ends, opposite the side to which the tape 118 was applied as best seen in FIG. 10. As applied, the tape 69 is aligned with the tape 118. The completed splice is indicated generally at 124 in FIGS. 1 and 2.

Again, if they are being used the trimmer heads 74 trim any portion of the tapes that may project beyond the side edges of the spliced web as it now begins to run from the apparatus 22 to the festoon assembly 40. After a suitable time delay, the power cylinders 64 and 76 return the vacuum roller 60 and trimmer heads 74 to their first positions.

As noted above, the butt splicing apparatus 20 may be used with a web processing means, such as a disposable diaper manufacturing line, that require that the web be run under relatively high speeds (for example, approximately eight hundred to one thousand feet per minute) and under relatively constant, relatively low tensions (for example, approximately 0.025 pli) applied uniformly across a relatively wide width web (for example, a twenty inch wide web). When the apparatus 20 is so utilized, each of the spindles 33 and 34, that mount the web rolls 30 and 32, is connected with conventional DC motors 126 and 128, respectively. These motors 126 and 128 are, in turn, connected in a normal manner, with conventional regenerative controllers, also known as regenerative adjustable, variable speed drives or four-quadrant drives, as generally indicated at 132 and 134 in FIG. 1. The controllers 132 and 134 control the operation of their respective motors 126 and 128. These motors drive the spindles 33 and 34 through conventional belt drive systems. The motors 126 and 128 may be 1 hp Model No. CDP3445 DC motors marketed by the Baldor Electric Co. of Fort Smith, Ark. These controllers 132 and 134 may be the Model No. 540 controllers marketed by Shackleton System Drives Corporation of Reston, Va. Sensors 136 and 138 may be used with the motors 126 and 128, respectively, to feedback a signal to their respective controllers 132 and 134 indicative of the speed that the respective motors are running. Each such sensors may be a tach generator Model BTG 1000 marketed by Baldor Electric Co. of Fort Smith, Ark.

The motors 126 and 128 and their respective controllers 132 and 134 are used to accelerate a new roll 30 or 32 up to the line speed as quickly as possible after a zero-speed splice so that the "dancer" rolls in the festoon assembly 40 will not "bottom out", that is, cause the tension in web W to increase. Similarly when the web W is running between splices, the motors and controllers also serve to maintain the desired speed in the running web W by continuously, selectively "driving" and/or "braking" the spindles.

To permit the motors 126 and 128 and their respective controllers 132 and 134 to accomplish their intended functions, they are connected to and their operations are controlled by a conventional programmable logic controller ("PLC") shown generally at 142, in a conventional manner. This PLC 142 may be the Model No. 5-15 marketed by the Allen-Bradley Co. of Milwaukee, Wis.

The PLC 142 operates the controllers 132 and 134 based on the information signals or input from a conventional web speed sensor 144 that senses the speed of the web W downstream from the festoon assembly 40 and from a conventional sensor 146 that senses the "position" of the floating dancer rollers 148 in the festoon assembly 40, relative to a preselected position.

The controllers 132 and 134 are controlled by the PLC 142 to maintain the rollers 148 at a preselected position before and after a splice.

The sensor 144 is not in physical contact with the web W. The sensor 144 may be Model No. BTG 1000 marketed by Baldor Electric Co. of Fort Smith, Ark. The sensor 146 is mounted on the dancer roller carriage, not shown, and is not in contact with any other members. The sensor 146 may be Model No. RS-120H-1-SAS marketed by Sunx Trading Co. of Tokyo, Japan. The sensors 144 and 146 are connected with the PLC 142 in a conventional manner.

When the apparatus 22 is used with a disposable diaper manufacturing line, the festoon assembly 40 should be engineered and function as described in aforementioned co-pending application Ser. No. 302,475 filed Jan. 26, 1989.

The PLC 142 further determines when a splice should be initiated. Given the diameter of the new roll (by an operator input signal), the speed of the motors 126 and 128, and thus the speed of the spindles 33 and 34, the PLC 142 will calculate when the web on the roll will expire and will accordingly initiate a splice in a timely manner.

The PLC may be programmed using conventional 6200 series software (PLC-5 Programming Terminal Software, Release 2.2) of the Allen-Bradley Co. of Milwaukee, Wis. The logic or ladder commands programmed in the PLC 142 are as follows:

```
Rung 2:0
|  N7:0  S:1                                          +BTW---------------+
+--]/[---] [-----------------------------------------+BLOCK TRNSFR WRITE+-(EN)--
|     15    15                                        |Rack              0|
|                                                     |Group             0+-(DN)
|                                                     |Module            0|
|                                                     |Control Block N7:0+-(ER)
|                                                     |Data file     N7:50|
|                                                     |Length           37|
|                                                     |Continuous        N|
|                                                     +------------------+

N7:0
            -BTW- 2:0

N7:0/15
            -]/[- 2:0

S:1/15
            -] [- 2:0

Rung 2:1
|   +LES---------------+                                                  0:005 |
+-+-+LESS THAN          +-------+-------------------------------------------( )--+
| | |Source A     N7:94|        |                                            00 |
| | |                 0|        |
| | |Source B    N7:151|        |
| | |               100|        |
| | +------------------+        |
| | 0:005                 0:005 |
| +--] [-----------------]/[--+
|      00                   01

N7:94
            -CPT- 2:5
            -GEQ- 2:2
            -GRT- 2:3
            -LEQ- 2:4
            -LES- 2:1
            -MOV- 4:1

N7:151
            -LES- 2:1

0:005/00
            -] [- 2:1
            -]/[- 2:2
            -( )- 2:1

0:005/01
            -] [- 2:2 2:10 2:14
            -]/[- 2:1
            -( )- 2:2

Rung 2:2
|   +GEQ---------------+                                                  0:005
+-+-+GRTR THAN OR EQUAL+-------+-------------------------------------------( )--
| | |Source A     N7:94|        |                                            01
| | |                 0|        |
| | |Source B    N7:157|        |
| | |               150|        |
| | +------------------+        |
| | 0:005                 0:005 |
| +--] [-----------------]/[--+
|      01                   00
```

```
N7:94
              -CPT- 2:5
              -GEQ- 2:2
              -GRT- 2:3
              -LEQ- 2:4
              -LES- 2:1
              -MOV- 4:1

N7:157
              -GEQ- 2:2

O:005/00
              -] [- 2:1
              -]/[- 2:2
              -( )- 2:1

O:005/01
              -] [- 2:2 2:10 2:14
              -]/[- 2:1
              -( )- 2:2

Rung 2:3
| +GRT---------------+                                  +MOV---------------+
+--+GREATER THAN      +-----------------------------------+MOVE              +-
| |Source A     N7:94|                                  |Source      N7:230|
| |                 0|                                  |                32|
| |Source B    N7:231|                                  |Dest        N7:164|
| |               530|                                  |                 0|
| +------------------+                                  +------------------+

N7:94
              -CPT- 2:5
              -GEQ- 2:2
              -GRT- 2:3
              -LEQ- 2:4
              -LES- 2:1
              -MOV- 4:1

N7:164
              -MOV- 2:3 2:4

N7:230
              -MOV- 2:3

N7:231
              -GRT- 2:3

Rung 2:4
| +LEQ---------------+                                  +MOV---------------
+--+LESS THAN OR EQUAL+-----------------------------------+MOVE              +--
| |Source A     N7:94|                                  |Source      N7:150|
| |                 0|                                  |                 0|
| |Source B    N7:232|                                  |Dest        N7:164|
| |               510|                                  |                 0|
| +------------------+                                  +------------------+

N7:94
              -CPT- 2:5
              -GEQ- 2:2
              -GRT- 2:3
              -LEQ- 2:4
              -LES- 2:1
              -MOV- 4:1

N7:150
              -MOV- 2:4 4:4 4:4

N7:164
              -MOV- 2:3 2:4

N7:232
              -LEQ- 2:4
```

```
Rung 2:5
|                                                          +CPT---------------+ |
+----------------------------------------------------------+COMPUTE            +-+
|                                                          |Dest        N7:158| |
|                                                          |                 2| |
|                                                          |Expression        | |
|                                                          |N7:94 + 2         | |
|                                                          +------------------+ |

N7:94
            -CPT- 2:5
            -GEQ- 2:2
            -GRT- 2:3
            -LEQ- 2:4
            -LES- 2:1
            -MOV- 4:1

N7:158
            -CPT- 2:5 2:6 2:7

Rung 2:6
|                                                          +CPT---------------+ |
+----------------------------------------------------------+COMPUTE            +-+
|                                                          |Dest        N7:153| |
|                                                          |                98| |
|                                                          |Expression        | |
|                                                          |F8:0 * N7:158     | |
|                                                          +------------------+ |

F8:0
            -CPT- 2:6

N7:153
            -CMP- 2:11 2:12
            -CPT- 2:6

N7:158
            -CPT- 2:5 2:6 2:7

Rung 2:7
|                                                          +CPT---------------+ |
+----------------------------------------------------------+COMPUTE            +--
|                                                          |Dest        N7:152| |
|                                                          |                 2| |
|                                                          |Expression        | |
|                                                          |F8:1 * N7:158     | |
|                                                          +------------------+ |

F8:1
            -CPT- 2:7

N7:152
            -CMP- 2:10
            -CPT- 2:7

N7:158
            -CPT- 2:5 2:6 2:7

Rung 2:8
| O:004                                                   +MOV---------------+ |
+--] [-----------------------------------------------------+MOVE               +-+
|    06                                                    |Source       N7:95| |
|                                                          |                 0| |
|                                                          |Dest        N7:156| |
|                                                          |                -1| |
|                                                          +------------------+ |

N7:95
            -MOV- 2:8
```

```
N7:156
            -CMP- 2:10 2:11 2:12
            -LEQ- 2:16
            -MOV- 2:8 2:9

O:004/06
            -] [- 2:8 2:23 4:4
            -]/[- 2:27
            -(L)- 2:19
            -(U)- 2:20

Rung 2:9
| O:004                                                    +MOV---------------+ |
+--] [-----------------------------------------------------+MOVE               +-+
|    05                                                    |Source       N7:96| |
|                                                          |                 -1| |
|                                                          |Dest        N7:156| |
|                                                          |                 -1| |
|                                                          +------------------+ |

N7:96
            -MOV- 2:9

N7:156
            -CMP- 2:10 2:11 2:12
            -LEQ- 2:16
            -MOV- 2:8 2:9

O:004/05
            -] [- 2:9 2:24 4:4
            -]/[- 2:28
            -(L)- 2:20
            -(U)- 2:19

Rung 2:10
| +CMP---------------+ I:002 O:005                                          O:004 |
+-+COMPARE            +--]/[---] [-----------------------------------------( )--+
| |Expression         |    06    01                                          04 |
| |N7:156 > N7:152    |                                                        |
| +------------------+                                                        |

I:002/06
            -] [- 2:14 2:18
          -]/[- 2:10 2:19 2:20

:152    60|                                                  |
|       +------------------+                                                |

B3/0
            -] [- 2:15 2:16
            -]/[- 2:14 2:34
            -(L)- 2:14
            -(U)- 2:22

B3/1
            -] [- 2:17 2:19 2:20 2:21
            -(L)- 2:16
            -(U)- 2:22

N7:156
            -CMP- 2:10 2:11 2:12
            -LEQ- 2:16
            -MOV- 2:8 2:9

N7:159
            -LEQ- 2:16
```

```
Rung 2:17
|   B3                                                  +TON---------------+        |
+--] [-----------------------------------------------+TIMER ON DELAY     +-(EN)-+
|     1                                               |Timer          T4:0|        |
|                                                     |Time base      0.01+-(DN)  |
|                                                     |Preset           20|        |
|                                                     |Accum             0|        |
|                                                     +------------------+        |

B3/1
            -] [- 2:17 2:19 2:20 2:21
            -(L)- 2:16
            -(U)- 2:22

T4:0
            -TON- 2:17

Rung 2:18
|  T4:0 I:002                                                                 O:004 |
+--] [---] [-----------------------------------------------------------------( )---+
|    DN    06                                                                   07 |

I:002/06
            -] [- 2:14 2:18
            -]/[- 2:10 2:19 2:20

O:004/07
            -( )- 2:18

T4:0.DN
            -] [- 2:18

Rung 2:19
|   B3  +CMP---------------+                                          O:004      |
+--] [--+COMPARE           +-----------------------------+----------(U)----+--
|     1 |Expression        |                             |              05   | |
|       |C5:0.ACC = 1      |                             |                   | |
|       +------------------+                             |                   | |
|                                                        | I:002   O:004     | |
|                                                        +--]/[--+--(L)--+-+
|                                                             06 |    06 |
|                                                                |   B3  |
|                                                                +--( )--+
|                                                                      2

B3/1
            -] [- 2:17 2:19 2:20 2:21
            -(L)- 2:16
            -(U)- 2:22

B3/2
            -] [- 2:21
            -( )- 2:19

C5:0.ACC
            -CMP- 2:19 2:20

I:002/06
            -] [- 2:14 2:18
            -]/[- 2:10 2:19 2:20

O:004/05
            -] [- 2:9 2:24 4:4
            -]/[- 2:28
            -(L)- 2:20
            -(U)- 2:19

O:004/06
            -] [- 2:8 2:23 4:4
            -]/[- 2:27
            -(L)- 2:19
            -(U)- 2:20
```

```
Rung 2:20
|   B3  +CMP---------------+                                          O:004
+--] [--+COMPARE            +-----------------------------+----------(U)----+-
|     1 |Expression         |                             |             06   |
|       |C5:0.ACC = 2       |                             |                  |
|       +-------------------+                             |                  |
|                                                         |                  |
|                                                        +++                +++
|                                                        +++                +++
|                                                         |                  |
|                                                         |                  |
|                                                         | I:002   O:004    | |
|                                                         +--]/[--+--(L)-----+ |
|                                                              06 |     05 | |
|                                                                 |   B3   | |
|                                                                 +--( )---  |
|                                                                       3    |
```

B3/1

```
-] [- 2:17 2:19 2:20 2:21
-(L)- 2:16
-(U)- 2:22
```

B3/3

```
-] [- 2:21
-( )- 2:20
```

C5:0.ACC

```
-CMP- 2:19 2:20
```

I:002/06

```
-] [- 2:14 2:18
-]/[- 2:10 2:19 2:20
```

O:004/05

```
-] [- 2:9 2:24 4:4
-]/[- 2:28
-(L)- 2:20
-(U)- 2:19
```

O:004/06

```
-] [- 2:8 2:23 4:4
-]/[- 2:27
-(L)- 2:19
-(U)- 2:20
```

```
Rung 2:21
| I:002   B3       B3                          +TON---------------+        |
+--]/[---] [--+--] [--+-----------------------+TIMER ON DELAY     +-(EN)-+
|    02     1 |      2 |                      |Timer          T4:1|        |
|             |        |                      |Time base     0.01+-(DN)  |
|             |        |                      |Preset           1|        |
|             |        |                      |Accum            0|        |
|             |        |                      +------------------+        |
|             |   B3   |                                                  |
|             +--] [--+                                                   |
|                  3                                                      |
```

B3/1

```
-] [- 2:17 2:19 2:20 2:21
-(L)- 2:16
-(U)- 2:22
```

B3/2

```
-] [- 2:21
-( )- 2:19
```

B3/3

```
-] [- 2:21
-( )- 2:20
```

```
I:002/02
              -] [- 2:14
              -]/[- 2:21

T4:1
              -TON- 2:21

Rung 2:22
| T4:1                                                                  B3
+--] [-----------------------------------------------------------------+--(U)--+--
|    DN                                                                |     0  |
|                                                                      |   B3   |
|                                                                      +--(U)--+
|                                                                            1

B3/0
              -] [- 2:15 2:16
              -]/[- 2:14 2:34
              -(L)- 2:14
              -(U)- 2:22

B3/1
              -] [- 2:17 2:19 2:20 2:21
              -(L)- 2:16
              -(U)- 2:22

T4:1.DN
              -] [- 2:22

Rung 2:23
| O:004                                                                O:004
+--] [-----------------------------------------------------------------( )---
|    06                                                                  02

O:004/02
              -( )- 2:23

O:004/06
              -] [- 2:8 2:23 4:4
              -]/[- 2:27
              -(L)- 2:19
              -(U)- 2:20

Rung 2:24
| O:004                                                                O:004
+--] [-----------------------------------------------------------------( )---
|    05                                                                  03

O:004/03
              -( )- 2:24

O:004/05
              -] [- 2:9 2:24 4:4
              -]/[- 2:28
              -(L)- 2:20
              -(U)- 2:19

Rung 2:25
| I:002                                                                O:004
+--] [-----------------------------------------------------------------( )---
|    00                                                                  00

I:002/00
              -] [- 2:25

O:004/00
              -( )- 2:25

Rung 2:26
| I:002                                                                O:005
+--] [-----------------------------------------------------------------( )---
|    03                                                                  02
```

```
I:002/03
            -] [- 2:26 2:27 2:28 4:4

O:005/02
            -] [- 2:29
            -]/[- 2:30
            -( )- 2:26

Rung 2:27
|   I:002   I:002                                                    O:005 |
+-+--] [--+--] [-----------------------------------------------------( )---
| |    04 |    03                                                     04 |
| | O:004 |                                                              |
| +--]/[--+                                                              |
|      06                                                                |

I:002/03
            -] [- 2:26 2:27 2:28 4:4

I:002/04
            -] [- 2:27 2:28

O:004/06
            -] [- 2:8 2:23 4:4
            -]/[- 2:27
            -(L)- 2:19
            -(U)- 2:20

O:005/04
            -( )- 2:27

Rung 2:28
|   I:002   I:002                                                    O:005 |
+-+--] [--+--] [-----------------------------------------------------( )--+
| |    04 |    03                                                     03 |
| | O:004 |                                                              |
| +--]/[--+                                                              |
|      05                                                                |

I:002/03
            -] [- 2:26 2:27 2:28 4:4

I:002/04
            -] [- 2:27 2:28

O:004/05
            -] [- 2:9 2:24 4:4
            -]/[- 2:28
            -(L)- 2:20
            -(U)- 2:19

O:005/03
            -( )- 2:28

Rung 2:29
| O:005                                          +TON---------------+      |
+--] [-----------------------------------------+TIMER ON DELAY    +-(EN)-+
|    02                                          |Timer          T4:2|      |
|                                                |Time base      1.0+-(DN) |
|                                                |Preset           5|      |
|                                                |Accum            0|      |
|                                                +------------------+      |

O:005/02
            -] [- 2:29
            -]/[- 2:30
            -( )- 2:26

T4:2
            -TON- 2:29
```

```
Rung 2:30
| 0:005
+--]/[-----------------------------------------------------+-+MOV-----------------+
|    02                                                    | |MOVE                 +-+-+
|                                                          | |Source      N7:234|  | |
|                                                          | |                 25|  | |
|                                                          | |Dest        N7:193|  | |
|                                                          | |                 25|  | |
|                                                          | +-------------------+  | |
|                                                          | +MOV-----------------+ | |
|                                                          +-+MOV                 +-+ |
|                                                            |Source      N7:236|     |
|                                                            |                  8|     |
|                                                            |Dest        N7:163|     |
|                                                            |                  8|     |
|                                                            +-------------------+     |
|
|
N7:163
            -MOV- 2:30 2:31

N7:193
            -MOV- 2:30 2:32

N7:234
            -MOV- 2:30

N7:236
            -MOV- 2:30

0:005/02
            -] [- 2:29
            -]/[- 2:30
            -( )- 2:26

Rung 2:31
|  T4:2                                                  0:005
+--] [-----------------------------------------------+--( )-----------------------+-
|    DN                                               |    05                       |
|                                                     | +MOV----------------+       |
|                                                     +-+MOV                +-------+
|                                                     | |Source      N7:235|       |
|                                                     | |                 45|       |
|                                                     | |Dest        N7:163|       |
|                                                     | |                  8|       |
|                                                     | +-------------------+       |
|                                                     | +TON----------------+       |
|                                                     +-+TIMER ON DELAY     +-(EN)-+
|                                                       |Timer          T4:3|
|                                                       |Time base       1.0+-(DN)
|                                                       |Preset            5|
|                                                       |Accum             0|
|                                                       +-------------------+
|
N7:163
            -MOV- 2:30 2:31

N7:235
            -MOV- 2:31

0:005/05
            -( )- 2:31

T4:2.DN
            -] [- 2:31

T4:3
            -TON- 2:31
```

```
Rung 2:32
|  T4:3                                                          +MOV---------------+
+--] [-----------------------------------------------------------+MOVE               +--
|     DN                                                         |Source       N7:233|
|                                                                |                 100|
|                                                                |Dest         N7:193|
|                                                                |                  25|
|                                                                +-------------------+
|

N7:193
              -MOV- 2:30 2:32

N7:233
              -MOV- 2:32

T4:3.DN
              -] [- 2:32

Rung 2:33
| I:002                                                                          O:004
+--] [-------------------------------------------------------------------------( )---
|     05                                                                          01

I:002/05
              -] [- 2:33

O:004/01
              -( )- 2:33

Rung 2:34
|   B3    C5:0                                                                   C5:0
+--]/[---] [-----------------------------------------------------------------(RES)--
|     0     DN

B3/0
              -] [- 2:15 2:16
              -]/[- 2:14 2:34
              -(L)- 2:14
              -(U)- 2:22

C5:0
              -CTU- 2:14
              -RES- 2:34

C5:0.DN
              -] [- 2:34

Rung 4:0
|                                                   +BTR---------------+          |
+---------------------------------------------------+-+BLOCK TRNSFR READ +-(EN)-+-+
|                                                   | |Rack              0|      | |
|                                                   | |Group             0+-(DN) | |
|                                                   | |Module            0|      | |
|                                                   | |Control Block N7:5+-(ER) | |
|                                                   | |Data file    N7:90|      | |
|                                                   | |Length           20|      | |
|                                                   | |Continuous        N|      | |
|                                                   | +------------------+       | |
|                                                   |  N7:5                        | |
|                                                   +--(U)-----------------------+ |
|                                                        15                        |

N7:5
              -BTR- 4:0

N7:5/15
              -(U)- 4:0
```

```
Rung 4:1
|                                                          +MOV---------------+ |
+----------------------------------------------------------+MOVE              +-+
|                                                          |Source       N7:94| |
|                                                          |                 0| |
|                                                          |Dest        N7:196| |
|                                                          |                 0| |
|                                                          +------------------+ |
|
N7:94
            -CPT- 2:5
            -GEQ- 2:2
            -GRT- 2:3
            -LEQ- 2:4
            -LES- 2:1
            -MOV- 4:1

N7:196
            -MOV- 4:1

Rung 4:2
|                                                        +PID--------------------+   |
+------------------------------------------------------+-+PID                    +-+--
|                                                      | |Control block    N7:160| | |
|                                                      | |Process variable  N7:98| | |
|                                                      | |Tieback                0| | |
|                                                      | |Control variable N7:154| | |
|                                                      | +-----------------------+ | |
|                                                      | N7:160                    | |
|                                                      +--(U)----------------------+ |
|                                                           15                         |

N7:98
            -PID- 4:2

N7:154
            -MOV- 4:4 4:4
            -PID- 4:2

N7:160
            -PID- 4:2

N7:160/15
            -(U)- 4:2

Rung 4:3
|                                                        +PID--------------------+
+------------------------------------------------------+-+PID                    +-+--
|                                                      | |Control block    N7:190| | |
|                                                      | |Process variable  N7:99| | |
|                                                      | |Tieback                0| | |
|                                                      | |Control variable N7:112| | |
|                                                      | +-----------------------+ | |
|                                                      | N7:190                    | |
|                                                      +--(U)----------------------+
|                                                           15                         |

N7:99
            -PID- 4:3

N7:112
            -PID- 4:3

N7:190
            -PID- 4:3

N7:190/15
            -(U)- 4:3
```

```
Rung 4:4
| I:002   O:004                                          +MOV---------------+      |
+--] [--+--] [-----------------------------------------+-+MOVE               +-+-+-+
|    03 |    05                                        | |Source      N7:154| | | |
|       |                                              | |                 91| | | |
|       |                                              | |Dest        N7:111| | | |
|       |                                              | |                  2| | | |
|       |                                              | +------------------+ | | |
|       |                                              | +MOV---------------+ | | |
|       |                                              +-+MOVE               +-+ | |
|       |                                                |Source      N7:150|   | |
|       |                                                |                  0|   | |
|       |                                                |Dest        N7:110|   | |
|       |                                                |                  0|   | |
|       |                                                +------------------+   | |
|       | O:004                                          +MOV---------------+   | |
|       +--] [-----------------------------------------+-+MOVE               +-+-+ |
|           06                                         | |Source      N7:154| | |
|                                                      | |                 91| | |
|                                                      | |Dest        N7:110| |
|                                                      | |                  0| |
|                                                      | +------------------+ |
|                                                      | +MOV---------------+ |
|                                                      +-+MOVE               +-+
|                                                        |Source      N7:150|
|                                                        |                  0|
|                                                        |Dest        N7:111|
|                                                        |                  2|
|                                                        +------------------+
```

I:002/03

```
-] [- 2:26 2:27 2:28 4:4
```

N7:110

```
-MOV- 4:4 4:4
```

N7:111

```
-MOV- 4:4 4:4
```

N7:150

```
-MOV- 2:4 4:4 4:4
```

N7:154

```
-MOV- 4:4 4:4
-PID- 4:2
```

O:004/05

```
-] [- 2:9 2:24 4:4
-]/[- 2:28
-(L)- 2:20
-(U)- 2:19
```

O:004/06

```
-] [- 2:8 2:23 4:4
-]/[- 2:27
-(L)- 2:19
-(U)- 2:20
```

```
Rung 4:5
|                                                +BTW-------------------+          |
+------------------------------------------------+-+BLOCK TRNSFR WRITE     +-(EN)-+-+
|                                                | |Rack                 0|       | |
|                                                | |Group                1+-(DN) | |
|                                                | |Module               0|       | |
|                                                | |Control Block     N7:10+-(ER) | |
|                                                | |Data file        N7:110|       | |
|                                                | |Length              13|       | |
|                                                | |Continuous           N|       | |
|                                                | +----------------------+       | |
|                                                | N7:10                          | |
|                                                +--(U)---------------------------+ |
|                                                     15                            |
```

N7:10

```
-BTW- 4:5
```

N7:10/15

```
-(U)- 4:5
```

N7:110

-MOV- 4:4 4:4

Rung 4:6

During the normal running of the web W, the PLC 142 receives a signal from the sensor 146 as to the position of the dancer rollers 148 and the speed of the web downstream from the assembly 40. Based on these signals, the PLC 142 controls the speed of the expiring or unwinding roll 30 or 32 through the motors 126 or 128.

The PLC 142 also "senses" or more particularly, determines the amount of web remaining on the expiring roll by calculating the amount of web left on that roll. When a splice is required, based on the remaining amount of web on the expiring roll, the PLC 142 causes the motor 126 or 128, through the controllers 132 or 134, to quickly stop the expiring roll. Thereafter, the splicing method described above proceeds. After the newly joined leading end of the new roll and the trailing end of the expiring roll have been unclamped, that is, are free to run through the apparatus 20, the PLC 142 causes the motor 126 or 128 (that is the motor connected with the spindle 33 or 34 on which the new roll is mounted) to drive the new roll up to line speed, while restoring the festoon assembly 40 (that is, the dancer rollers 148) to their running position. Thereafter the PLC 142, working through the motors 126 and 128 and the controllers 132 and 134, will again maintain the line speed of the web W based on the position of the dancer rollers in the assembly 40, with respect to a preselected position, and the speed of the web W downstream from the assembly 40.

The preferred embodiment of the present invention has now been described. This preferred embodiment constitutes the best mode contemplated by the inventors for carrying out their invention. Because their invention may be copied without copying the precise details of the preferred embodiment, the following claims particularly point out and distinctly claim the subject matter which the inventors regard as their invention and wish to protect:

We claim:

1. An improved method for forming a butt splice to join together a web from a new roll of material to a web which is from an expiring roll of material, which has two, substantially parallel side edges, and which should be run, through a web processing operation downstream from the expiring roll, at a high speed and under a constant, low preselected tension, along a predetermined path of travel that includes running web festoon means having floating dancer rollers and the web processing operation, the improved method comprising the steps of:

driving the expiring roll at a speed so as to maintain the web, downstream of the running web festoon means, at a high speed and under a constant, low tension and so as to maintain the dancer rollers of the running web festoon means in their normal running position;

holding a portion of the web from the new roll against anvil means that includes a cutting edge;

trimming the portion of the web from the new roll along the cutting edge of the anvil means so that the trimmed edge of the downstream, leaving end of the web from the new roll is aligned with and conforms to the cutting edge of the anvil means;

applying a first piece of adhesive tape to the leading end of the web from the new roll so that the adhesive of the tape faces the path of travel and so that a portion of the adhesive tape extends downstream beyond the cutting edge of the anvil means and the trimmed edge of the web from the new roll;

sensing the amount of web remaining on the expiring roll;

momentarily stopping the running of the portion of the web from the expiring roll adjacent to the anvil means in response to the sensed expiration of web from the expiring roll, while permitting further downstream portions of the web from the expiring roll, remote from the anvil means, to continue to run at the high speed and under the constant, low tension;

holding the stopped, anvil means adjacent portion of the web from the expiring roll against the anvil means;

trimming the stopped, anvil means adjacent portion of the web from the expiring roll along the cutting edge of the anvil means by cutting the stopped, anvil means adjacent portion of the web from the expiring roll a part at a time, across the web and beginning at one side edge thereof, so that the point of cutting moves across the stopped, anvil means adjacent portion of the web from the expiring roll from the one side edge to the other side edge, so that the uncut part of the stopped, anvil means adjacent portion of the web from the expiring roll remains under tension ahead of the point of cutting, and so that the trimmed edge of the trailing end of the stopped, anvil means adjacent portion of the web from the expiring roll is aligned with and conforms to the cutting edge of the anvil means;

adhering the cut part of the trailing end of the stopped, anvil means adjacent portion of the web from the expiring roll, behind the point of cutting, to the downstream extending portion of the adhesive tape substantially simultaneously as the point of cutting moves across the stopped, anvil means adjacent portion of the web from the expiring roll, so that the trimmed edge of the trailing end of the stopped, anvil means adjacent portion of the web from the expired roll abuts and is disposed closely adjacent to the trimmed edge of the leading end of the web from the new roll, and so that the adhesive tape secures together the leading end of the web from the new roll and the trailing end of the web from the expiring roll and;

driving the new roll at a speed so as to bring the joined web from the expiring roll and from the new roll so that the dancer rollers of the running web festoon means are again restored to their normal running position, and so that the web continues at the high speed and under the constant, low tension.

2. The improved method of claim 1 wherein the anvil means is disposed adjacent to the path of travel; wherein the portion of the web from the new roll is held against one side of the anvil means; wherein the stopped, anvil means adjacent portion of the web from the expiring web is held against another side of the anvil means; and wherein the adhesive tape faces the anvil means, when applied to the leading end of the web from the new roll; and including the further steps of: applying the adhesive tape from one side edge to the other side edge of the leading end of the web from the new roll; and supporting the portion of the adhesive tape that extends downstream beyond the cutting edge of the anvil means and the leading end of the web of the new roll while the trailing end of the stopped, anvil means adjacent portion of the web from the expiring roll is being trimmed and while the cut part of the trailing end of the stopped, anvil means adjacent portion of the web from the expiring roll is being adhered to the portion of the adhesive tape.

3. An improved apparatus for forming a butt splice to join together a web from a new roll of material to a web which is from an expiring roll of material, which has two substantially parallel side edges, and which should be run, through a web processing operation downstream from the expiring roll, at a relatively high preselected speed and under a constant, low tension, along a pre-determined path of travel that includes running web festoon means having floating dancer rollers and the web processing operation, the improved apparatus comprising:

means for driving the expiring roll at a speed so as to maintain the web, downstream of the running web festoon means at the high speed and under the constant, low tension and so as to maintain the dancer rollers of the running web festoon means in their normal running position;

an anvil disposed adjacent to the path of travel and having first and second sides and a cutting edge at the downstream ends of the sides;

means for supporting and driving the expiring roll and the new roll so that each web on each roll may run off of the roll and past the anvil and so that each roll may be selectively driven at various speeds;

means for selectively holding a portion of the web from the new roll against the first side of the anvil;

means for selectively trimming off the web from the new roll along the cutting edge of the anvil so that the trimmed edge of the leading end of the web from the new roll is aligned with and conforms to the cutting edge of the anvil and so that a first piece of adhesive tape can be applied to one side of the leading end, with the adhesive on the adhesive tape facing the path of travel and with an exposed portion of the adhesive tape projecting downstream beyond the cutting edge of the anvil and the trimmed edge of the web from the new roll;

means for sensing the amount of web remaining on the expiring roll;

means responsive to the means for sensing the amount of web remaining on the expired roll, for momentarily stopping the running of the portion of the web from the expiring roll adjacent to the anvil while permitting the further downstream portions of the web from the expiring roll, remote from the anvil, to continue to run at the high speed and under the constant, low tension;

means for selectively holding the stopped, anvil adjacent portion of the web from the expiring roll against the second side of the anvil;

means for trimming the stopped, anvil adjacent portion of the web from the expiring roll along the cutting edge of the anvil by cutting the stopped, anvil adjacent portion of the web from the expiring roll a part at a time, across the web and beginning at one side edge thereof, so that the point of cutting moves across the stopped, anvil adjacent portion of the web from the expiring roll from the one side edge to the other side edge, so that the uncut part of the web from the expiring roll remains under tension ahead of the point of cutting, and so that the trimmed edge of the trailing end of the stopped, anvil adjacent portion of the web from the expiring roll is aligned with and conforms to the cutting edge of the anvil;

means for applying the cut part of the trailing end of the stopped, anvil adjacent portion of the web from the expiring roll, behind the point of cutting, to the downstream extending, exposed portion of the adhesive tape substantially simultaneously as the point of cutting moves across the stopped, anvil adjacent portion of the web from the expiring roll so that the trimmed edge of the trailing end of the stopped, anvil adjacent portion of the web from the expiring roll abuts and is disposed closely adjacent to the trimmed edge of the leading end of the web from the new roll, and so that the adhesive tape secures together the leading end of the web from the new roll and the trailing end of the web from the expiring roll; and means for driving the new roll at a speed so as to bring the joined leaving end of the web from the new roll and the trailing end of the web of the exiting roll, so that as the joined web runs along the path of travel, the dancer rollers of the running web festoon means are again restored to their normal running position, and so that the web continues at the high speed and under the constant, low tension.

4. The improved apparatus of claim 3 which includes means for supporting the portion of the adhesive tape and the leaving end of the web from the new roll while the stopped, anvil adjacent portion of the web is trimmed and while the trailing end of the stopped, anvil adjacent portion of the web from the expiring roll is adhered to the portion of the adhesive tape; and wherein the cutting edge of the anvil is disposed at an acute angle with respect to the path of travel.

5. The improved apparatus of claim 4 wherein the means for adhering the cut part of the trailing end of the stopped, anvil adjacent portion of the web from the expiring roll includes a contact roller whose axis of rotation is substantially parallel to the path of travel adjacent to the anvil, with the roller being disposed immediately downstream from the cutting edge of the anvil, adjacent to the second side of the anvil, and having a peripheral surface that, when in contact with the trailing end of the stopped, anvil adjacent portion of the web from the expiring roll, projects beyond the plane of the second side of the anvil toward the plane of the first side of the anvil, the contact roller also being movable across the anvil, adjacent to the cutting edge, from one side edge of the web from the expiring roll to the other.

* * * * *